US009098010B2

(12) United States Patent
Koyanagi et al.

(10) Patent No.: US 9,098,010 B2
(45) Date of Patent: Aug. 4, 2015

(54) DEVELOPMENT DEVICE, PROCESS CARTRIDGE, AND IMAGE FORMING APPARATUS

(71) Applicant: CANON KABUSHIKI KAISHA, Tokyo (JP)

(72) Inventors: Masato Koyanagi, Mishima (JP); Gosuke Goto, Kawasaki (JP); Kazutoshi Ishida, Mishima (JP); Masahiro Kurachi, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 60 days.

(21) Appl. No.: 13/776,333

(22) Filed: Feb. 25, 2013

(65) Prior Publication Data

US 2013/0223891 A1 Aug. 29, 2013

(30) Foreign Application Priority Data

Feb. 27, 2012 (WO) ..... PCT/JP2012/054799

(51) Int. Cl.
*G03G 15/08* (2006.01)

(52) U.S. Cl.
CPC ..... *G03G 15/0812* (2013.01); *G03G 15/0818* (2013.01); *G03G 2215/0651* (2013.01)

(58) Field of Classification Search
CPC ..... G03G 15/0818; G03G 15/0812; G03G 2215/0651
USPC ..... 399/279, 284, 274
See application file for complete search history.

(56) References Cited

U.S. PATENT DOCUMENTS

| | | | | | |
|---|---|---|---|---|---|
| 4,200,665 | A | * | 4/1980 | Suzuki et al. | |
| 4,786,936 | A | * | 11/1988 | Ikegawa et al. | 399/274 |
| 5,339,141 | A | * | 8/1994 | Suzuki et al. | |
| 5,467,175 | A | * | 11/1995 | Takagaki et al. | 399/284 |
| 5,742,885 | A | * | 4/1998 | Wayman | |
| 5,870,658 | A | * | 2/1999 | Goto et al. | 399/284 |
| 2011/0188897 | A1 | * | 8/2011 | Goto | |

FOREIGN PATENT DOCUMENTS

| | | | | |
|---|---|---|---|---|
| JP | 3-233477 | A | | 10/1991 |
| JP | 7-013410 | A | | 1/1995 |
| JP | 07319279 | A | * | 12/1995 |
| JP | 3162219 | B2 | | 2/2001 |
| JP | 3272056 | B2 | | 1/2012 |

* cited by examiner

*Primary Examiner* — Susan Lee
(74) *Attorney, Agent, or Firm* — Canon USA, Inc. IP Division

(57) ABSTRACT

An image forming apparatus is provided which includes a development device that has no developer supply member and with which the decrease in density at a back end of a solid image and occurrence of ghosting are suppressed. A development roller having dielectric portions scattered on a surface thereof is provided and components are configured so that the position of the dielectric portions in a triboelectric series is on the same polarity side, relative to a regulating blade, as the normal charge polarity of the toner.

24 Claims, 24 Drawing Sheets

FIG. 4A
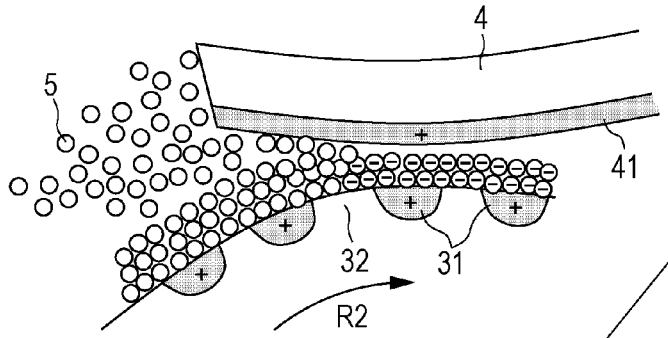
FIG. 4B
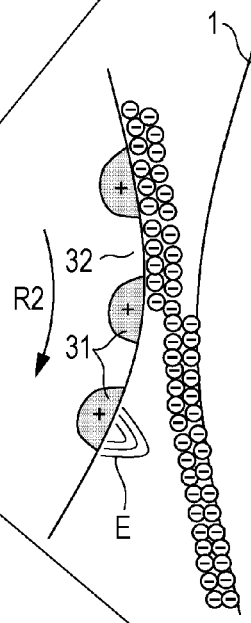
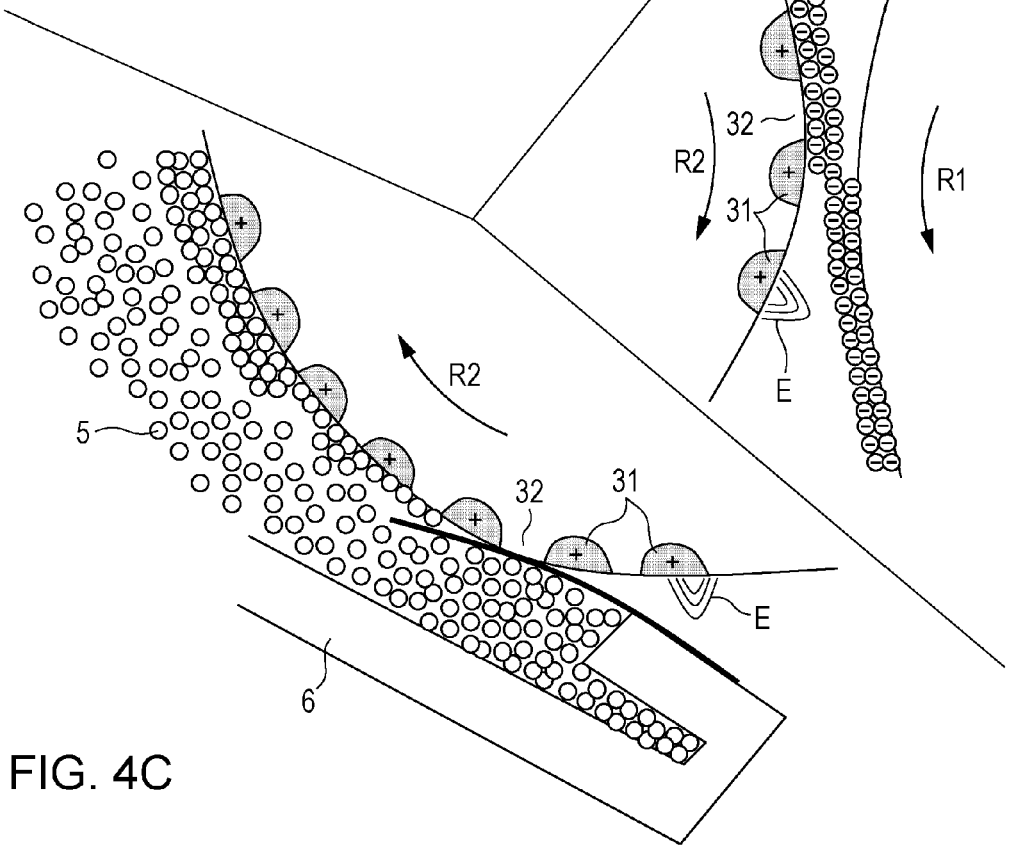
FIG. 4C

FIG. 5A
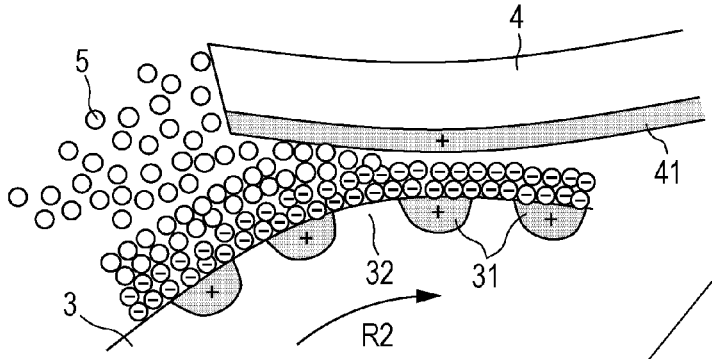
FIG. 5B
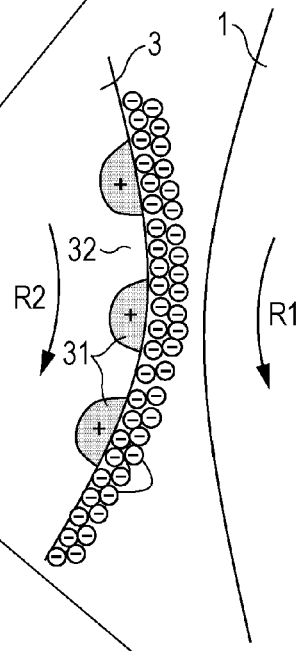
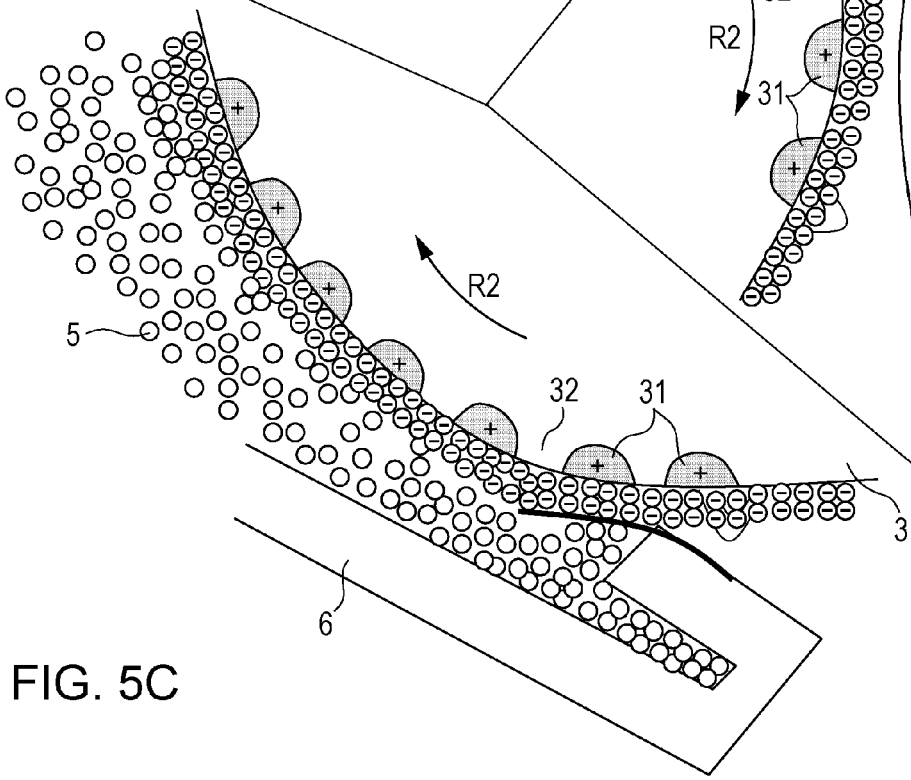
FIG. 5C

DEVELOPMENT DEVICE, PROCESS CARTRIDGE, AND IMAGE FORMING APPARATUS

TECHNICAL FIELD

The present invention relates to a development device used in an image forming apparatus that employs an electrophotographic method.

BACKGROUND ART

Existing image-forming apparatuses are known to experience a phenomenon called ghosting in which the history of image formation appears as afterimages in subsequent image formation. For example, when a halftone image is formed after formation of a high-density solid image, the trace of the solid image often appears in the halftone image, resulting in ghosting. Also known is a phenomenon in which the density at a back end of an image is low when a high-density solid image is formed.

In order to suppress ghosting and the decrease in density at the back end of a solid image, a supply roller (toner supplying member) that contacts a developing roller (toner bearing member) and supplies and removes the toner is widely employed in typical development devices. That is, ghosting can be suppressed by erasing the history of the image formation remaining on the developing roller by using the removing action of the supply roller. The decrease in density at the back end of a solid image can be suppressed by supplying new toner from the supply roller to the developing roller.

However, a development device not quipped with the supply roller has been proposed to reduce the size and cost of the development device.

PTL 1 and PTL 2 each propose a development device that includes a toner bearing member employing a structure in which dielectric portions are scattered on its surface but that does not include a supply roller. That is, the dielectric portions on the surface of the toner bearing member are rubbed with a toner layer thickness regulating member (regulating member) either directly or with the toner therebetween so as to charge the dielectric portions and form microfields between the dielectric portions and surrounding regions thereof. The toner transported to the surface of the toner bearing member receives gradient force from the microfields and becomes attracted to the surface of the toner bearing member, and thus the toner bearing member bears the toner. In PTL 1 and PTL 2, it is described that in order to stabilize the charge amount of the toner on the toner bearing member, the position of the dielectric portions in a triboelectric series should be on the polarity side, relative to the regulating member, opposite to the normal charge polarity (charge polarity for developing electrostatic latent images) of the toner. For example, when the toner is negatively charged, the triboelectric series should be (−) toner<regulating member<dielectric portions (+).

CITATION LIST

Patent Literature

PTL 1 Japanese Patent No. 03272056

PTL 2 Japanese Patent No. 03162219

However, studies conducted by the inventors have found that when the position of the dielectric portions in the triboelectric series is on the polarity side, relative to the regulating member, opposite to the normal charge polarity of the toner as in the related art, ghosting is likely to occur. According to the structure of the related art, the toner electrostatically strongly adheres to the dielectric portions, resulting in difficulty to regulate the thickness of the toner layer and there is a tendency of not being able to sufficiently erase the history of previous image formation remaining on the developing roller.

Accordingly, an object of the present invention is to suppress the decrease in density at the back end of a solid image and occurrence of ghosting in a development device that does not have a toner supply member that contacts a toner bearing member and supplies and removes the toner.

SUMMARY OF INVENTION

To achieve the object described above, a first invention according this application is a development device that includes a container that contains a toner, a toner bearing member that has dielectric portions scattered on a surface thereof and bears the toner, and a regulating member that regulates a layer thickness of the toner on the toner bearing member, in which a position of the dielectric portions in a triboelectric series is on the same polarity side, relative to the regulating member, as a normal charge polarity of the toner.

To achieve the object described above, a second invention according to this application is an image forming apparatus that includes a development device that includes a container that contains a toner, a toner bearing member that has dielectric portions scattered on a surface thereof and bears the toner, and a regulating member that regulates a layer thickness of the toner on the toner bearing member; and a voltage applying device that applies a voltage to the regulating member so that a potential difference obtained by subtracting a potential of the dielectric portions from a potential of the regulating member has a polarity opposite to a normal charge polarity of the toner.

Further features of the present invention will become apparent from the following description of exemplary embodiments with reference to the attached drawings.

BRIEF DESCRIPTION OF DRAWINGS

FIGS. 4A to 4C are diagrams illustrating a development system according to the embodiment 1.

FIGS. 5A to 5C are diagrams illustrating a development system according to the embodiment 1.

DESCRIPTION OF EMBODIMENTS

An image forming apparatus according to the present invention will now be described in further detail by referring to drawings. The embodiments described below are merely illustrative and the dimensions, materials, shapes, relative positions, etc., of the structural components described below do not limit the scope of the present invention unless specifically described.

Embodiment 1

Image Forming Apparatus

Figure 1:
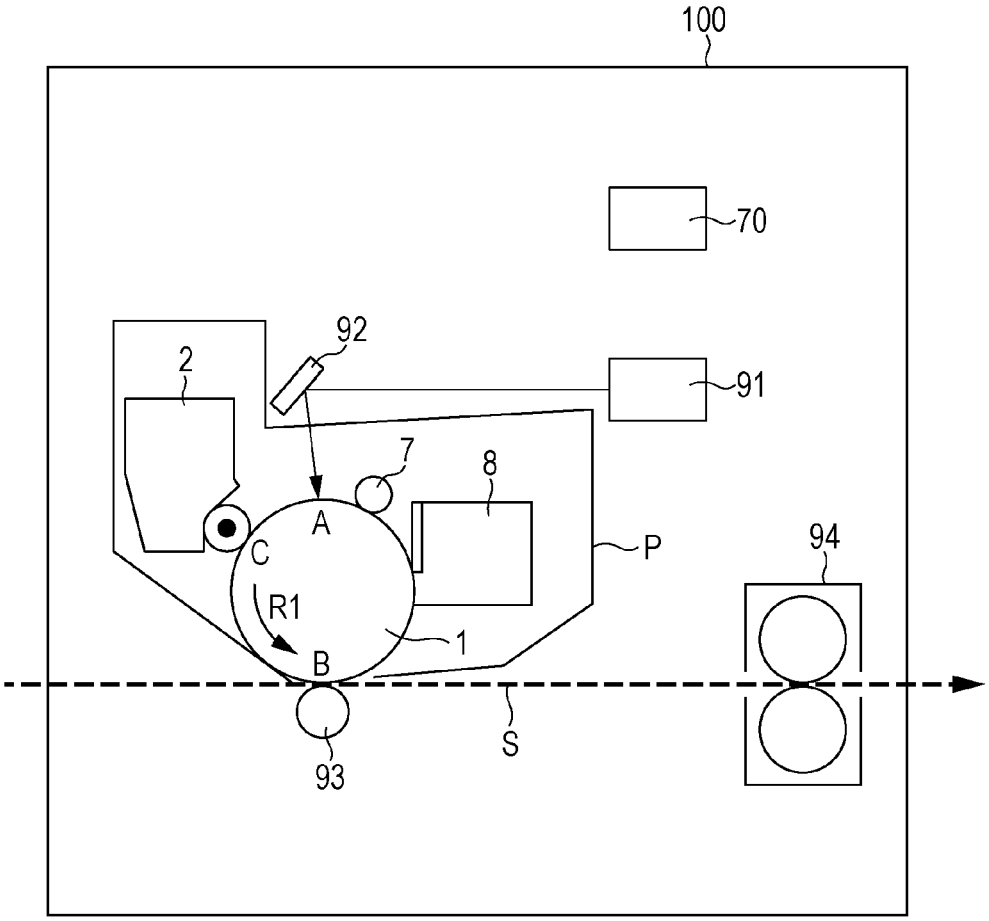
FIG. 1 is a schematic structural diagram of an image forming apparatus according to embodiment 1.

FIG. 1 shows a schematic structure of an image forming apparatus 100 according to this embodiment. The image forming apparatus 100 of this embodiment includes, as main structures, a photosensitive drum 1, a development device 2, a cleaning device 8, a charging roller 7, an exposure device 91, a transfer roller 93, and a fixing unit 94. The photosensitive drum 1, the development device 2, the cleaning device 8, and the charging roller 7 are integrated into a process cartridge P which is removably loadable to the image forming apparatus main body (the image forming apparatus 100 with the process cartridge P removed). The development device 2 contains a toner having a negative normal charge polarity (the charge polarity for developing electrostatic latent images; in this embodiment, a negatively charged electrostatic latent image is reversely developed and thus the normal charge polarity of the toner is negative).

The exposure device 91 and a reflecting mirror 92 are arranged so that a laser beam emitted from the exposure device 91 reaches an exposure position A on the photosensitive drum 1 via the reflecting mirror 92. The transfer roller 93 is disposed under the photosensitive drum 1. A transfer material S after the transfer is conveyed to the fixing unit 94. The cleaning device 8 is disposed downstream of the transfer position in the drum moving direction. An attached blade is arranged to make contact so as to scrape off the toner on the photosensitive drum 1.

The image forming operation of the image forming apparatus will now be described. A controller 70 generally controls the following image forming operation in accordance with a particular control program and lookup tables. First, the surface of the photosensitive drum 1 rotating in the arrow R1 direction at 100 mm/sec is charged to a particular potential by using the charging roller 7. At the exposure position A, an electrostatic latent image is formed on the photosensitive drum 1 with a laser beam emitted from the exposure device 91 in accordance with an image signal. The formed electrostatic latent image is developed at a development position C with the development device 2 to form a toner image. The toner image formed on the photosensitive drum 1 is transferred to the transfer material S at a transfer position B. The transfer material S serving as a recording medium and onto which the toner image has been transferred is conveyed to the fixing unit 94. The fixing unit 94 pressurizes and heats the toner image on the transfer material S to fix the toner image on the transfer material S and form a final image.

Next, the structure of the development device according to this embodiment is described.

Figure 2:
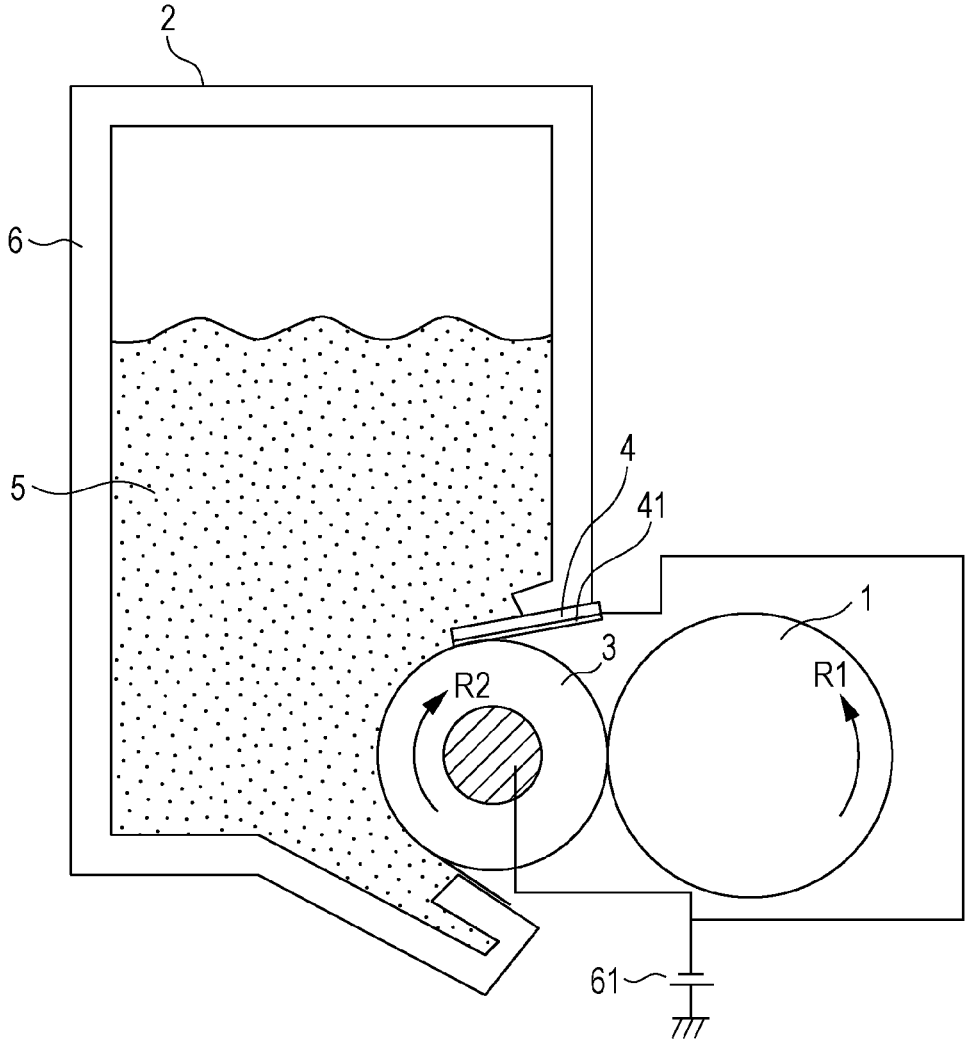
FIG. 2 is a schematic structural diagram of a development device etc., according to the embodiment 1.

FIG. 2 is a schematic structural diagram showing the development device 2 etc., of this embodiment. The photosensitive drum 1 that functions as an image bearing member has an outer diameter of 24 mm and is rotated in the arrow R1 direction at a peripheral speed of 150 mm/sec. The development device 2 is disposed on the left side of the photosensitive drum 1. Known charging means, exposure means, transfer means, cleaning means, fixing device, etc., (not shown) are disposed around the photosensitive drum 1 so as to carry out an electrophotographic process.

The development device 2 of this embodiment includes a development container 6, a development roller 3, and a regulating blade 4 as shown in FIG. 2. The development container 6 contains a toner 5 which is a nonmagnetic monocomponent developer. The development roller 3 serving as a toner bearing member has an outer diameter of 12 mm and is rotated in the arrow R2 direction at a peripheral speed of 180 mm/sec. In this embodiment, the development roller 3 is in direct contact with the surface of the photosensitive drum 1. The regulating blade 4 functions as a regulating member that regulates the thickness of the toner layer on the development roller. The regulating blade 4 includes a charging layer 41 and functions as charge imparting means for imparting particular charges to the dielectric portions on the development roller 3 through the toner 5 and toner charging means for imparting particular charges to the toner 5.

The present invention involves a structure in which a toner supply member in contact with the development roller 3 is omitted and the aforementioned gradient force is used to bear two or more layers of toner on the surface of the development roller 3. Accordingly, dielectric portions and conductive portions are provided on the surface of the development roller 3 and the surface is rubbed with the regulating blade 4 through the toner so as to charge the dielectric portions and form microfields on the portions adjacent to the conductive portions. The toner transported to the surface of the development roller 3 receives the gradient force from the microfields and becomes borne on the surface of the developer bearing member by being attracted thereto.

Figure 3A:
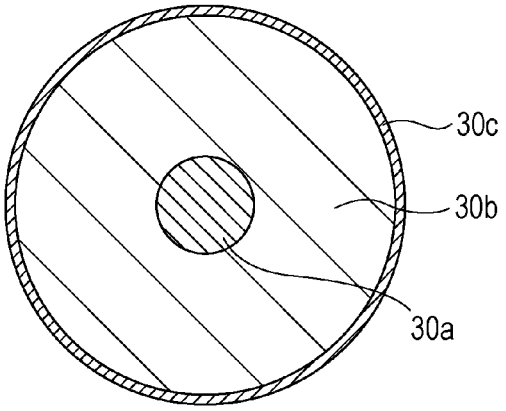
FIGS. 3A to 3C are, respectively, a diagram showing a layer structure of a development roller, a plan view, and a cross sectional view according to the embodiment 1.
Figure 3B:
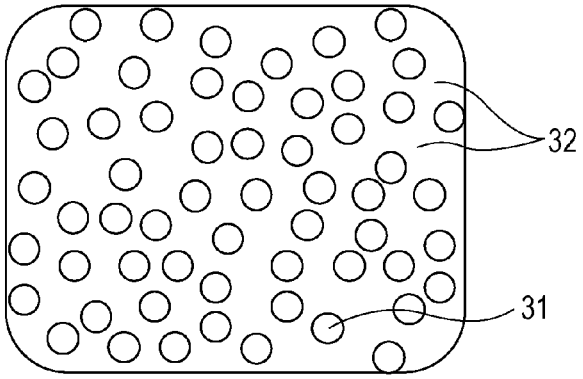
Figure 3C:
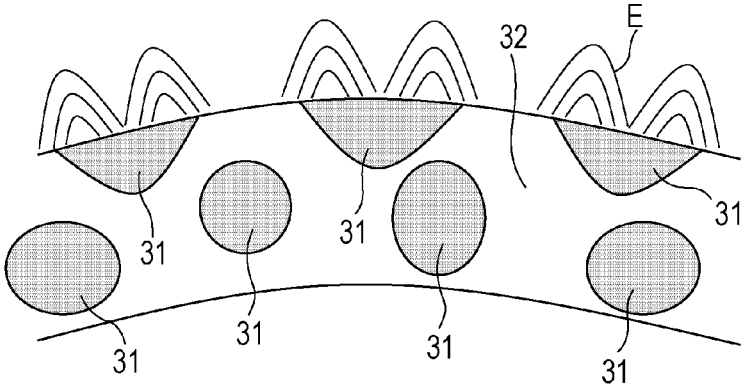

The surface of the development roller 3 of this embodiment is configured so that dielectric portions that can retain charges and conductive portions adjacent to the dielectric portions both having small areas are mixed and exposed. In particular, as shown in FIG. 3A, an elastic layer 30*b* composed of a conductive rubber material and a surface layer 30*c* are disposed on the outer periphery of an axial core 30*a* to constitute the development roller 3. The development roller 3 can be prepared by forming a surface layer 30*c* composed of a conductive resin material containing dispersed dielectric particles by coating or the like on the elastic layer 30*b* and polishing the surface thereof. A plan view of the development roller 3 is shown in FIG. 3B and a cross sectional view is shown in FIG. 3C. When the dielectric portions 31 are charged by a particular method, microfields are formed as shown by electrical flux lines E shown in FIG. 3C.

The size of the dielectric portions 31 is preferably about 5 to 500 μm in outer diameter. This is a value optimum for retaining charges on the surface and suppressing banding. When the outer diameter is larger than 5 μm, sufficient charges can be retained on the surface of the dielectric portions 31 and sufficient microfields can be formed. When the outer diameter is less than 500 μm, the difference in potential between the dielectric portions 31 and conductive portions 32 is not excessively large and the banding can be suppressed. Furthermore, the dielectric portions 31 are required to retain an appropriate degree of potential difference with respect to the conductive portions 32 and retain microfields during the period from when the dielectric portion passes the toner layer thickness regulating position defined by the regulating blade 4 to when the dielectric portion passes the toner layer thickness regulating position next time (the rotation period T of the development roller 3). Accordingly, the electrical resistance R and the capacitance C of the dielectric portions 31 preferably satisfy $CR \geq T/Ln\ 10$ (Ln: natural logarithm) with respect to the rotation period T of the development roller 3. In this manner, the dielectric portions 31 charged at the toner layer thickness regulating position by the regulating blade 4 can retain at least 10% of the charge amount after elapse of the rotation period T. In this embodiment, the above-described relationship is satisfied and the microfields are retained with $CR \geq 0.091$.

In order to form microfields indicated by electrical flux lines E shown in FIG. 3C, the charge that the conductive portions 32 retain is preferably as small as possible. Accordingly, the electrical resistance R and the capacitance C of the conductive portions 32 preferably satisfy $CR < T/Ln\ 100$ (Ln: natural logarithm) with respect to the rotation period T of the development roller 3, for example. In this manner, even when the dielectric portions 31 are composed of a chargeable material, the charge amount attenuates to less than 1% after elapse of the rotation period T. In this embodiment, the above-described relationship is satisfied and microfields are formed with $CR < 0.045$.

The volume resistivity of dielectric particles was measured by applying a voltage of 1000 V to a measurement sample for 30 seconds using a resistivity meter Hiresta-UP produced by Mitsubishi Chemical in a 23° C./50% RH environment. The amount of the measurement sample used is preferably appropriately adjusted by considering the particle density or the like of the object to be measured. For example, when measuring acrylic resin particles, 0.6 g of the particles are compacted under a pressure of 2000 kgf/cm2 and used as the measurement sample. The dielectric constant of the dielectric particles is measured as follows. First, a powder sample is placed in a cylinder having a base area of 2.26 $cm^2$ and 15 kg of pressure is applied to the upper and lower electrodes. Simultaneously, an AC voltage of 1 Vpp and 1 MHz is applied and the current at that time is measured. The results are normalized to calculate the dielectric constant. The CR measurement of the dielectric portions 31 on the surface of the development roller 3 may be replaced by charging the dielectric portions 31 by a particular method and measuring the attenuation rate thereof. For example, a measurement sample having a 1 cm×1 cm surface and a thickness of 3 mm is cut out from the development roller 3 and irradiated with plus ions from ZEROSTAT 3 produced by MILTY Products Limited. Then the potential of the dielectric portions 31 is measured with a scanning probe microscope (SPA300, produced by SII Nanotechnology Inc.) in a KFM mode at particular time intervals and CR can be calculated from the potential attenuation rate.

In order to form the surface layer 30*c* shown in FIGS. 3A to 3C, for example, acrylic resin particles are dispersed in a urethane resin serving as a binder. Examples of the conductive substance that can be used to impart conductivity to the surface layer 30*c* include carbon black and ion-conducting substances. In this embodiment, the content of the conductive substance in the surface layer 30*c* is adjusted to 0.20 parts by mass relative to 100 parts by mass of the urethane resin so that the urethane resin portions function as the conductive portions 32. Acrylic resin particles having an average particle diameter of 30 μm are employed in the dielectric portions 31. (In this specification, the average particle diameter means a 50% cumulative particle size (d50) or a 90% cumulative particle size (d90) measured by DLS, in particular, a Microtrac method, at 20° C. and a 0.01 mass % solid content concentration.) In this embodiment, the acrylic resin particle content is 70 parts by mass relative to 100 parts by mass of the urethane resin so that, regarding the dielectric portion/conductive portion area ratio, the area of the dielectric portions accounts for about 50% of the entirety.

Although details are described below, the development system of this embodiment uses the relationship among the work functions of the dielectric portions 31 on the surface of the development roller 3, the charging layer 41 of the regulating blade 4, and the toner. The work function of the material used in the dielectric portions on the surface of the development roller 3 was 5.7 eV when measured with a surface analyzer (AC-2 produced by Riken Keiki Co., Ltd.) at an irradiation dose of 250 nW.

The regulating blade 4 in this embodiment has a charging layer 41*a*. In particular, it is prepared by laminating the polyamide resin on a phosphor bronze metal thin sheet. The thickness of the phosphor bronze metal thin sheet was 0.1 mm and the thickness of the polyamide resin was 0.1 mm in this embodiment. The work function of the charging layer 41 determined by the aforementioned measurement method was 5.42 eV.

A negatively chargeable toner that uses a non-magnetic styrene acryl-based+polyester-based resin was used as the toner 5 of this embodiment. The work function of the toner 5 measured by the aforementioned method was 6.01 eV.

In this embodiment, a DC voltage of −300 V was applied as the development bias for contact development to the development roller 3 from a DC power source 61 and a latent image was designed on the photosensitive drum 1 so that the potential of a solid white image portion was −500 V and the potential of a solid image portion was −100 V. In this embodiment, in order to obtain a preferable image density, the toner coat amount on the photosensitive drum 1 during formation of the solid image needs to be 0.54 mg/cm2 and in order to achieve this, the toner coat amount on the development roller 3 needs to be 0.45 mg/cm2.

In this embodiment, the materials for the dielectric portions 31 of the development roller 3, the charging layer 41 of the regulating blade 4, and the toner 5 are selected so that the above-described work functions are achieved and that the order in the triboelectric series is (−) toner 5<dielectric portions 31<charging layer 41 (+). According to this structure, friction between the toner 5 and the charging layer 41 and between the toner 5 and the dielectric portions 31 can impart negative charges to the toner 5 and positive charges to the charging layer 41 and the dielectric portions 31. Moreover, according to the triboelectric series described above, friction between the toner 5 and the charging layer 41 and between the toner 5 and the dielectric portions 31 generates a potential difference between the surface of the development roller 3 and the surface of the charging layer 41 so that the toner 5 migrates to the charging layer 41.

The development system of this embodiment is described below with reference to FIGS. 4A to 4C (solid image formation) and FIGS. 5A to 5C (solid white image formation). In this embodiment, all of the toner on the development roller 3 is used for development to form a solid image. In FIGS. 4A to 4C and 5A to 5C, open particles of the toner 5 are the toner that has zero or low charge and particles that include a minus sign (−) are the toner that has been regulated and charged between the surface of the development roller 3 and the charging layer 41.

First, formation of a solid image is described. As shown in FIG. 4A, negative charges were imparted to the toner 5 and positive charged were imparted to the charging layer 41 and the dielectric portions 31 by the friction between the toner 5 and the charging layer 41 and between the toner 5 and the dielectric portions 31 at the regulating position. In this manner, microfields described above are formed between the dielectric portions 31 and the conductive portions 32. As shown in FIG. 4B, all of the toner on the development roller 3 is used for development in the development portion. After the development, the surface of the development roller is recovered into the development container 6, and about three layers of the toner are formed by the gradient force of the microfields formed on the development roller 3 in the development container 6 as shown in FIG. 4C. A toner coat amount of about two layers is constantly obtained on the development roller 3 at the regulating position during formation of the solid image as shown in FIG. 4A, and thus failure to track the solid image described above can be suppressed (detailed description is provided below).

Next, formation of a solid white image is described. As with the formation of a solid black image, microfields described above are formed between the dielectric portions 31 and the conductive portions 32 at the regulating position. In the development portion, as shown in FIG. 5B, all of the toner on the development roller 3 is headed toward the recovery portion of the development container. From the recovery portion and in the development container 6, about four layers of the toner are formed due to the gradient force of microfields formed on the development roller 3 as shown in FIG. 5C. At the regulating position, a toner coat amount of about two layers can be obtained on the development roller 3 by the regulation that uses the difference in triboelectric series rank between the development roller 3 and the charging layer 41 according to the present invention even during formation of a solid white image as shown in FIG. 5A. In other words, the toner coat amount after passing the regulating position is made the same between when a solid image is formed and when a solid white image is formed so as to suppress generation of ghost images described above (detailed description is provided below).

The ghost image suppressing mechanism featured in the present invention will now be described in detail with reference to FIGS. 6A to 6F and 7A to 7F. Open particles of the toner 5 shown in FIGS. 6A to 6F and 7A to 7F are the toner that has zero or low charge and particles that include a minus sign (−) are the toner that has been regulated and charged by the surface of the development roller 3 and the charging layer 41 and the toner that has tumbled on the surface of the development roller 3 and become charged.

Figure 6A:
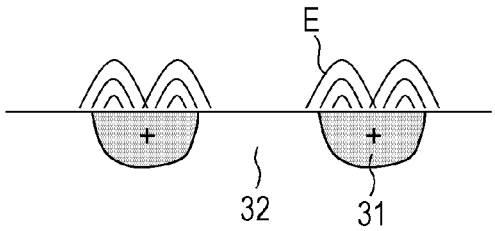
FIGS. 6A to 6F are diagrams illustrating a toner adhering mechanism according to the embodiment 1.
Figure 6D:
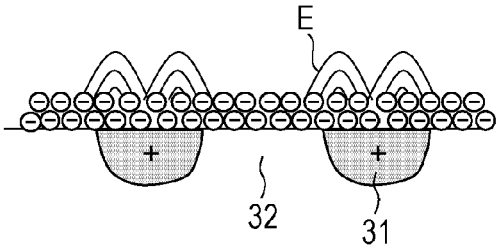
Figure 6B:
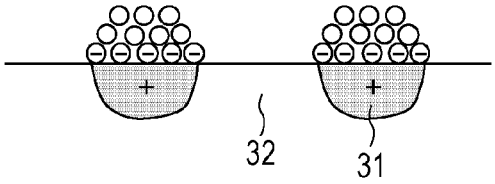
Figure 6E:
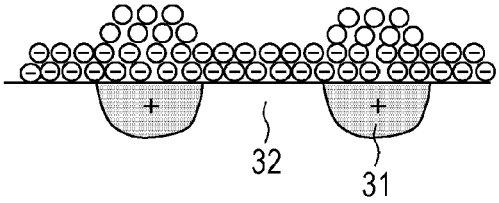
Figure 6C:
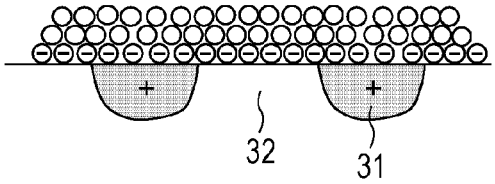
Figure 6F:
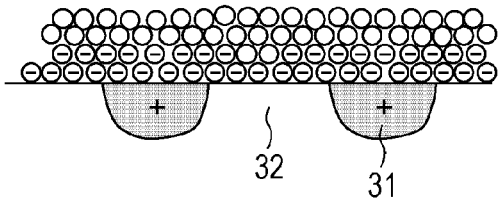

The mechanism with which the toner adheres to the surface of the development roller 3 during formation of a solid image is described with reference to FIGS. 6A, 6B, and 6C, and the toner adhesion mechanism during formation of a solid white image is described with reference to FIGS. 6D, 6E, and 6F. During formation of a solid image, the surface of the development roller 3 has no toner coat while returning to the inside of the development container 6 as shown in FIG. 6A. The toner having zero or low charge is attracted by the gradient force to the surfaces of the dielectric portions 31 where microfields are generated and the toner that has come into contact with the surface of the development roller 3 is negatively charged as shown in FIG. 6B. This adhering toner forms irregularities on the roller surface as shown in FIG. 6B and the toner is supported in the gaps of the irregularities, thereby forming about three layers of the toner as shown in FIG. 6C. In contrast, during the formation of a solid white image, negative charges of the toner coat accumulate on the surface of the development roller 3 and thus the surface potential of the toner layer on the dielectric portions 31 and the conductive portions 32 shifts toward the negative side and microfields E are formed as shown in FIG. 6D. Then the toner having zero or low charge is attracted to the surfaces of the conductive portions 32 where the microfields are generated as shown in FIG. 6E and forms irregularities on the roller surface. The toner is supported in the gaps between the irregularities to thereby form about four layers of the toner as shown in FIG. 6F.

Figure 7A:
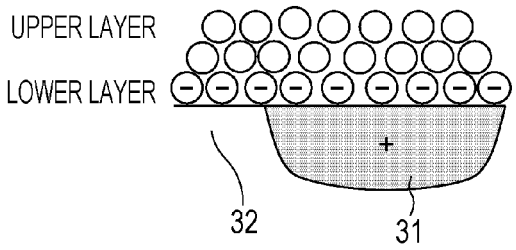
FIGS. 7A to 7F are diagrams illustrating a toner layer regulating mechanism according to the embodiment 1.
Figure 7D:
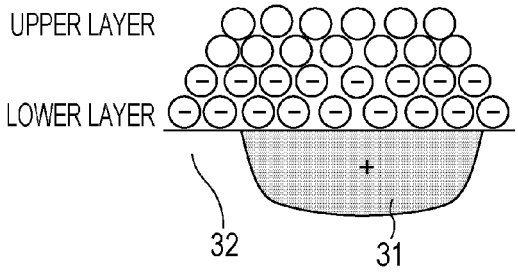
Figure 7B:
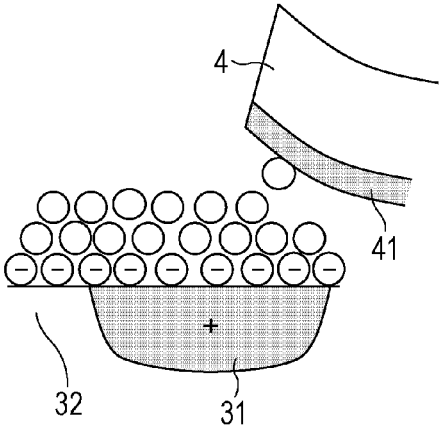
Figure 7E:
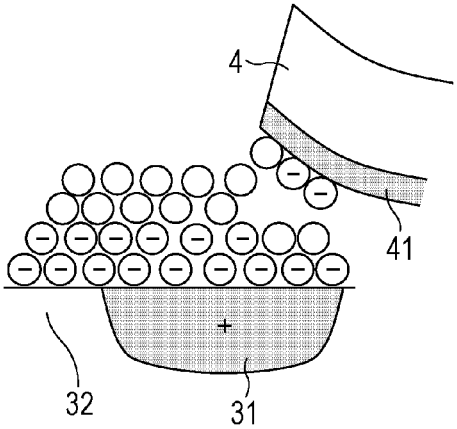
Figure 7C:
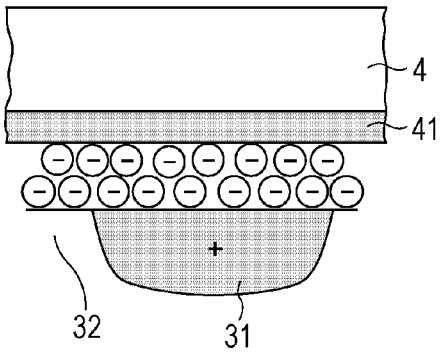
Figure 7F:
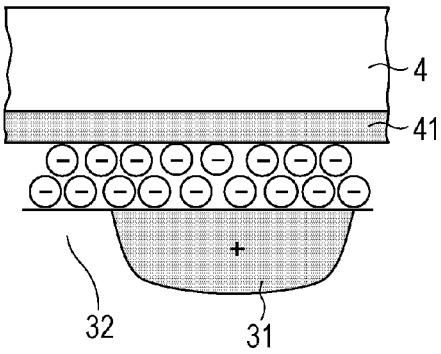
Figure 8A:
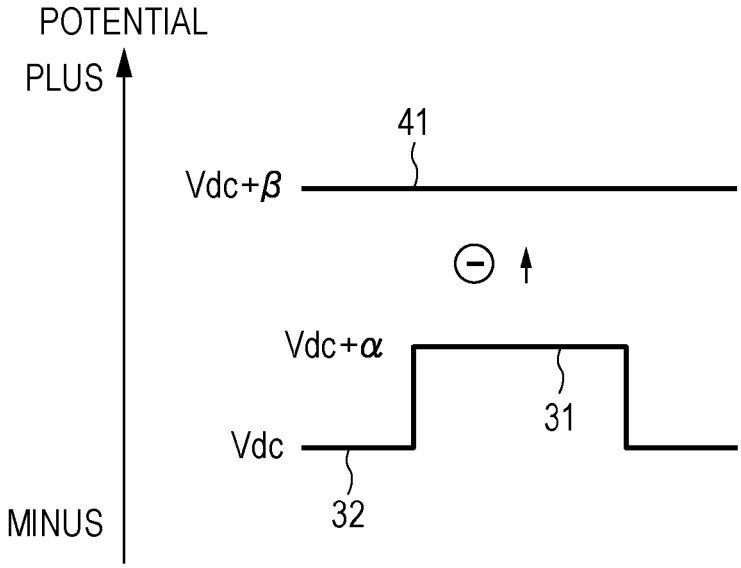
FIGS. 8A and 8B are potential graphs of conductive portions 32, dielectric portions 31, and a charging layer 41 according to the embodiment 1.

Next, the mechanism with which the toner layer on the surface of the development roller 3 is regulated by the regulating blade 4 during formation of a solid image is described with reference to FIGS. 7A, 7B, and 7C, and the toner layer regulating mechanism during formation of a solid white image is described with reference to FIGS. 7D, 7E, and 7F. In forming a solid image, as shown in FIG. 7A, about three layers of toner are formed on the surface of the development roller 3 and, as shown in FIG. 7B, the toner in the upper layer weakly constrained by gradient force is mechanically removed from the surface of the development roller 3. The toner in the lower layer is transported to the regulating position and negatively charged as shown in FIG. 7C. In contrast, in forming a solid white image, about four layers of toner are formed on the surface of the development roller 3 and regulated as shown in FIG. 7D. This embodiment is designed so that the order of the triboelectric series is (−) toner 5<dielectric portions 31<charging layer 41 (+). Accordingly, the potential relationship among the conductive portions 32, the dielectric portions 31, and the charging layer 41 is conductive portions 32=development bias (Vdc hereinafter), dielectric portions 31=Vdc+$\alpha$, and charging layer 41=Vdc+$\beta$ as shown in FIG. 8A ($\alpha<\beta$ due to the difference in work function). In this manner, as shown in FIG. 7E, the minus toner on the surface of the development roller 3 is readily removed from the surface of the development roller 3 due to the electric field between the charging layer 41 and the dielectric portions 31.

At this time, compared with when a solid image is formed, the minus toner is disposed in the upper layer at a higher level and thus the amount of toner removed by the electric field is increased.

In other words, in this embodiment, the toner coat amount after passing the regulating position is made the same between when a solid image is formed and when a solid white image is formed due to the toner adhering mechanism to the surface of the development roller 3 and the toner layer regulating mechanism discussed above so that occurrence of ghost images can be significantly suppressed. Here, a detail description is provided by comparing the formation of a solid image and formation of a solid white image in which the difference in the condition of the toner coating on the surface of the development roller 3 is most obvious. However, the toner coat amount after passing the regulating position can be made the same due to the aforementioned mechanisms even during formation of a halftone image. Images were formed on 1000 A4 size sheets by using the image forming apparatus of this embodiment shown in FIG. 1. An appropriate image density was maintained, image defects did not occur, and satisfactory images were obtained.

As discussed above, the image forming apparatus of this embodiment includes the development roller 3 having dielectric portions 31 scattered on the surface and other components are configured so that, in a triboelectric series, the position of the dielectric portions 31 is on the same polarity side, relative to the regulating blade 4, as the normal charge polarity of the toner. In this manner, an image forming apparatus that includes a development device having no developer supply member, suppresses the decrease in density at the back end of a solid image, and suppresses occurrence of ghosting can be provided.

Figure 8B:
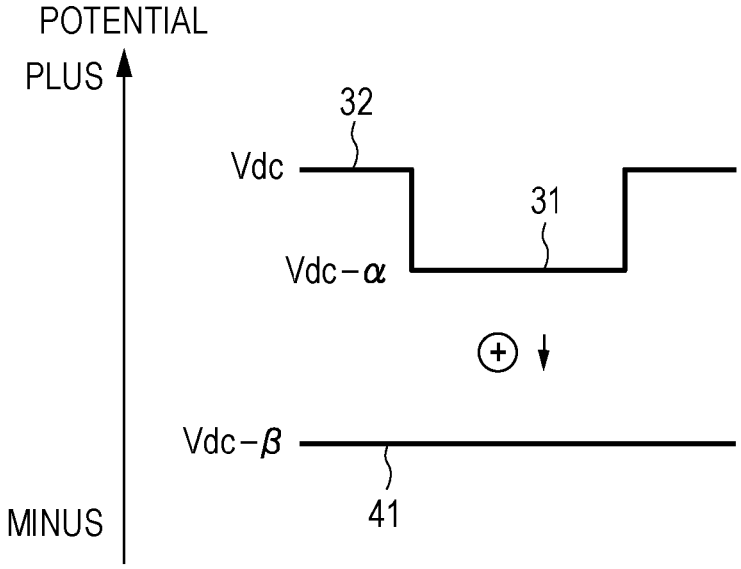

In this embodiment, the materials for the development roller 3, the regulating blade 4, and the toner 5 are as described above but are not particularly limited as long as the position of the dielectric portions in a triboelectric series is on the same polarity side, relative to the regulating blade 4, as the normal charge polarity of the toner. For example, when the toner is positively charged, the materials should be selected so that (−) charging layer 41<dielectric portions 31<toner 5 (+) and that the potential relationship among the conductive portions 32, the dielectric portions 31, and the charging layer 41 is as shown in FIG. 8B.

The effects of the present invention can be achieved regardless of whether the charging layer 41 is electrically conductive or insulating. In order to prevent charge up on the elastic blade and prevent the toner from carrying unnecessary charges, the charging layer 41 is preferably electrically conductive.

Figure 9A:
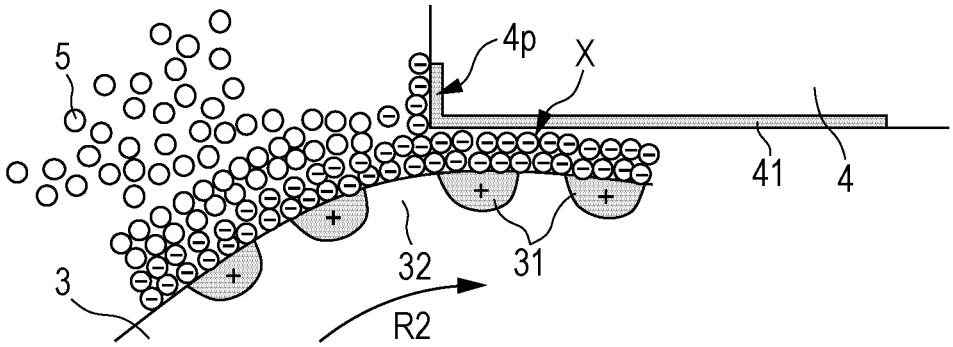
FIGS. 9A and 9B are diagrams illustrating other regulating methods according to the embodiment 1.
Figure 9B:
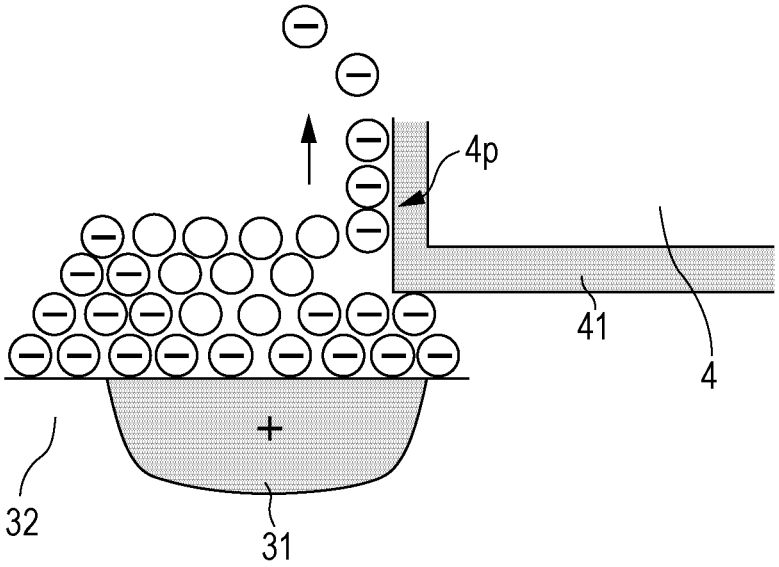

In order to further enhance the effects of the present invention, as shown in FIG. 9A, an end surface of the regulating blade 4 is arranged to face in the normal line direction with respect to the development roller 3. In other words, the end of the regulating blade 4 has a guiding portion 4*p* that guides the toner to outside the opposing region X where the regulating blade 4 opposes the development roller 3. The position of the guiding portion 4*p* in the triboelectric series is on the polarity side, relative to the dielectric portions 31, opposite to the normal charge polarity of the toner. In this manner, as shown in FIG. 9B, the minus toner in the upper layer removed by the electric field adheres to the charging layer 41 in the guiding portion 4*p* and pushed up by the minus toner subsequently transported, thereby being guided in the arrow direction. Accordingly, the minus toner removed by the electric field does not stay near the regulating position and the minus toner in the upper layer on the surface of the development roller 3 is removed more reliably. Thus, the ghosting suppressing effect of the present invention can be further enhanced.

Figure 10A:
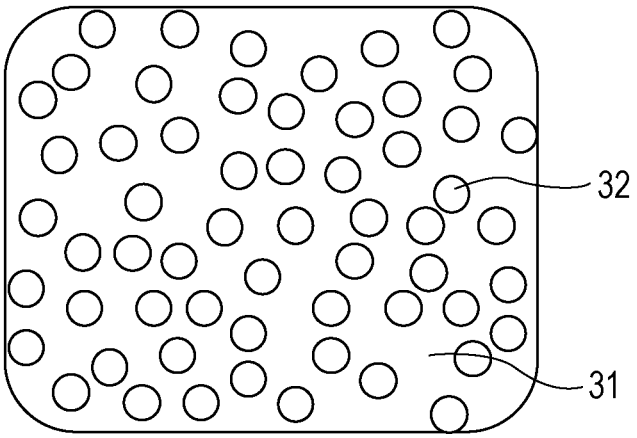
FIGS. 10A and 10B are, respectively, a plan view and a cross sectional view showing a structure of another development roller according to the embodiment 1.
Figure 10B:
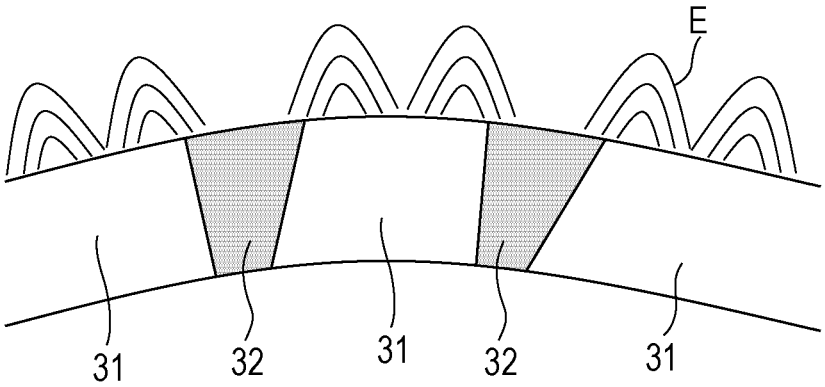

The development roller 3 of this embodiment has a structure in which dielectric portions 31 are scattered on the surface. Here, "scatter" means not only a state in which dielectric portions are separated from one another but also a state in which dielectric portions are continuous as shown in FIG. 10A. In other words, it is sufficient if the dielectric portions 31 are distributed regularly or at random at a particular ratio with respect to the entire surface without gathering in one place. In FIG. 10A, the dielectric portions 31 correspond to the sea in the sea-island structure and the conductive portions 32 correspond to the island in the sea-island structure. As shown in FIG. 10B, the conductive portions 32 are in contact with the conductive layer underneath. According to this structure also, microfields are formed as indicated by the electrical flux lines E shown in FIG. 10B by charging the dielectric portions 31 by a particular method so that the same effects as those in this embodiment are obtained.

Figure 11:
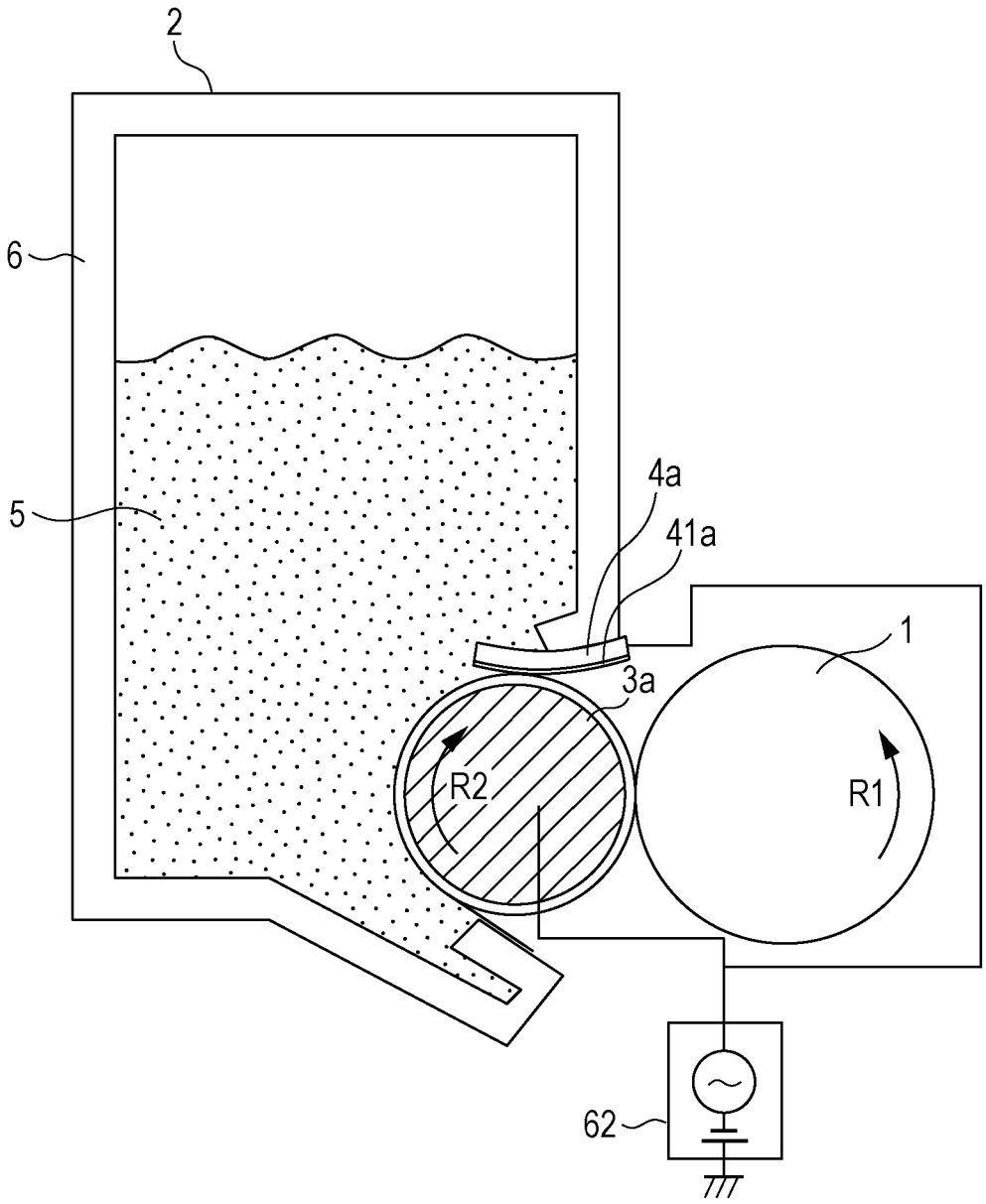
FIG. 11 is a schematic structural diagram of another development device etc., according to the embodiment 1.
Figure 12A:
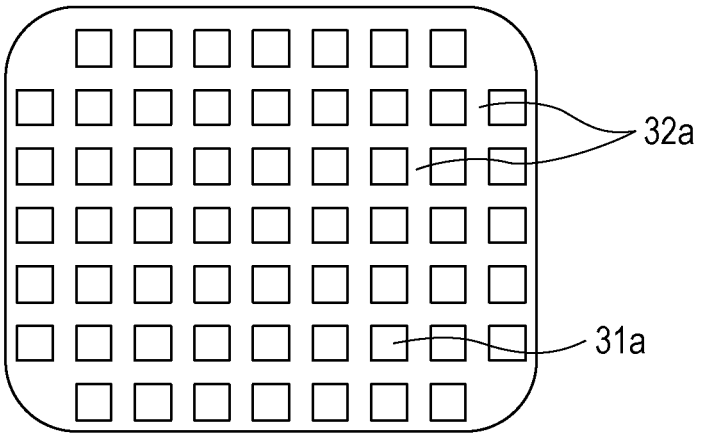
FIGS. 12A and 12B are, respectively, a plan view and a cross sectional view of a knurled development roller according to the embodiment 1.
Figure 12B:
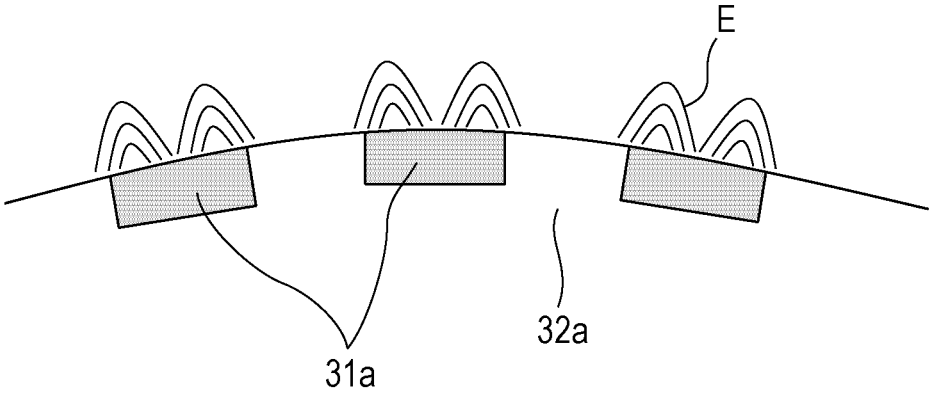

In this embodiment, the photosensitive drum 1 and the development roller 3 are configured to make direct contact with each other. Alternatively, in order to eliminate the pressure applied to the toner during contact development, the photosensitive drum 1 and a development roller 3*a* may be arranged in a non-contact manner as shown in FIG. 11. In such a case, the size and the area ratio of the dielectric portions and the conductive portions can be easily controlled by employing a knurled development roller 3*a* shown in FIGS. 12A and 12B. In particular, after forming particular grooves by knurling the surface of a cored roller, the surface is coated with an insulating material such as a resin. Then the surface is machined so that the core portions exposed in the surface serve as the conductive portions 32 and the resin in the grooves and exposed in the surface serves as the dielectric portions 31. A plan view of the development roller 3*a* is shown in FIG. 12A and a cross sectional view is shown in FIG. 12B. The aforementioned acrylic resin is used as the dielectric particles. As the regulating member, an elastic blade 4*a* having a charging layer 41*a* is used. According to the structure shown in FIG. 11, development is conducted by applying an AC/DC superimposed bias as the development bias from a power source 62. Even for the non-contact development, the same effects as those of this embodiment can be achieved when the development roller and the regulating member are configured as such.

Embodiment 2

Next, another embodiment of the image forming apparatus according to the present invention is described.

Figure 13A:
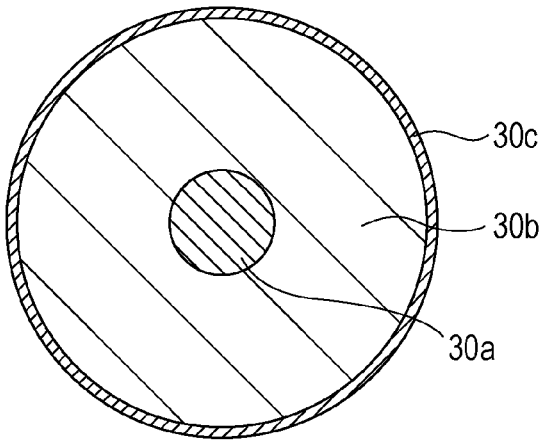
FIGS. 13A to 13C are, respectively, a diagram showing a layer structure of a development roller having irregularities on a surface, a plan view, and a cross sectional view according to embodiment 2.
Figure 13B:
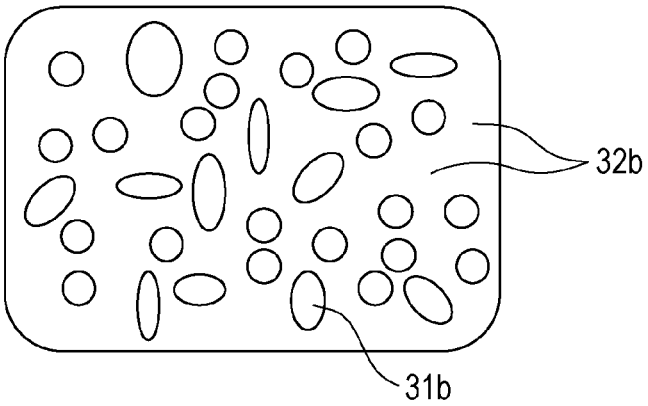
Figure 13C:
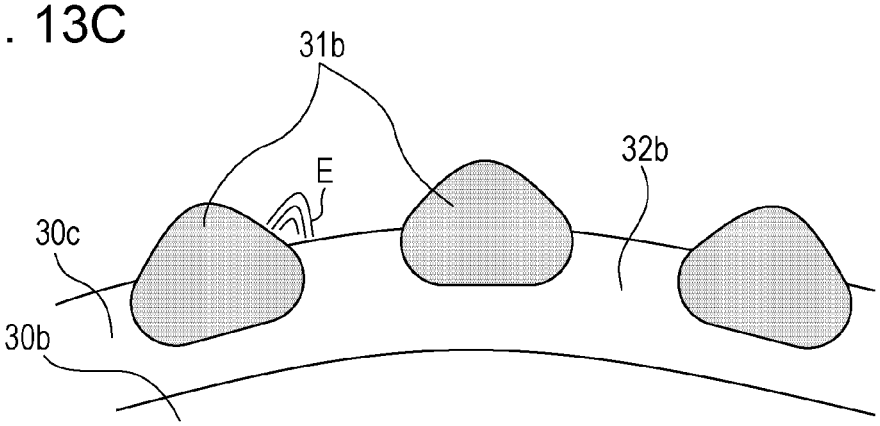

The feature of this embodiment is that, in the image forming apparatus described in embodiment 1, the surface of the development roller 3 has protrusions and the dielectric portions 31 are present in the protrusions as shown in FIGS. 13A to 13C. Moreover, in this embodiment, the end surface of the regulating blade 4 is arranged to face in the normal line direction with respect to the development roller 3 so that the end surface can easily track the irregularities on the surface of the development roller 3. Other main structures are the same as in Example 1. In this embodiment, the dielectric portions 31 are formed in the protrusions so that the dielectric portions 31 can be directly triboelectrically charged with the charging layer 41 and thus the dielectric portions 31 can be charged negative, which is the same polarity as that of the toner.

In this embodiment, the development roller 3 includes an elastic layer 30*b* composed of a conductive rubber material and a surface layer 30*c* on the outer periphery of an axial core 30*a* as shown in FIG. 13A. A plan view of the development roller 3 is shown in FIG. 13B and a cross sectional view is shown in FIG. 13C. The surface layer 30*c* has a sea-island type phase separation structure constituted by a domain phase that contains a polyester copolymer resin composed of chemical formulae (A) and (B) and a matrix phase of a polyester melamine resin that contains chemical formulae (A), (B), and (C).

(A)

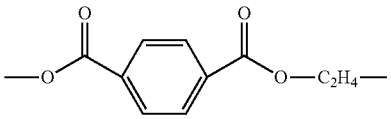

(B)

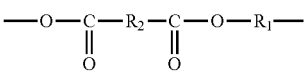

(C)

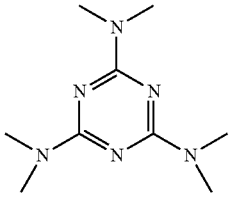

In formula (B), $R_1$ represents a linear alkylene group having 2 or more and 9 or less carbon atoms or a branched alkylene group having 6 or more and 9 or less carbon atoms and $R_2$ represents a linear alkylene group having 2 or more and 8 or less carbon atoms.

This surface layer features that the domain phase constituted by dielectric portions and the matrix phase constituted by conductive portions in which conductive fine particles are localized are mixed and exposed in small areas. The domain phase functions as dielectric portions 31*b* and the matrix phase functions as the conductive portions 32*b* described above. When the dielectric portions 31*b* are charged by a particular method, microfields are formed as indicated by electrical flux lines E shown in FIG. 13C.

The equivalent circle diameter of the dielectric portions 31*b* is preferably 10 μm or more. At 10 μm or more, a sufficient charge potential amount for retaining the toner can be obtained. The equivalent circle diameter here refers to a diameter of a circle having the same area as the area of the domain phase projected onto the development roller surface. The domain phase in the present invention can be identified with a scanning electron microscope (SEM), scanning transmission electron microscope (STEM), or the like. As for the area ratio of these portions, the area of the dielectric portions is controlled to account for about 50% of the entirety. In this embodiment, the thickness of the surface layer 30*c* is 10 μm. The surface roughness of the development roller 3 having protruding dielectric portions can be controlled by controlling the phase separation structure. An example of the method for forming a coating film having a sea-island type phase separation structure is a method with which a highly crystalline resin material solid at room temperature is dissolved in an solvent in a supersaturated amount so as to form a coating film. A highly crystalline resin material has a property to easily precipitate into crystals in some parts by evaporation of the solvent during formation of the coating film. These precipitated sites of the crystals that are protruded form the domain portions and the portion where the coating film is continuous forms a matrix portion so as to form a sea-island type phase separation structure. The domain phase, i.e., the degree of precipitation of crystals, depends on the crystallinity of the polyester copolymer resin in this embodiment. The important point is that the crystallinity of the polyester copolymer resin is controlled in terms of crystal size and coverage by optimizing the molecular structure. The phase separation structure, i.e., the size of the domain, can be controlled through the boiling point and evaporation speed of the solvent and SP value in addition to optimizing the crystallinity of the resin material.

The localization of the conductive fine particles in the matrix phase was confirmed through mapping analysis with a scanning probe microscope (SPM). As a result, it has been found that whereas the region in the domain shape exhibits insulating property, the surrounding matrix region exhibits electrical conductivity. The work function of the material used in the dielectric portions on the surface of the development roller 3 was 5.6 eV when measured with a surface analyzer (AC-2, produced by Riken Keiki Co., Ltd.) at an irradiation dose of 250 nW.

Figure 14A:
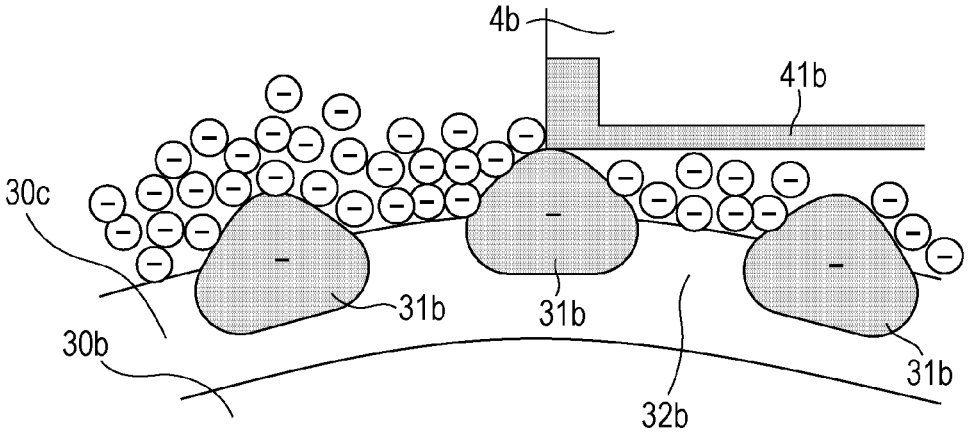
FIGS. 14A and 14B are diagrams illustrating a development system according to the embodiment 2.
Figure 14B:
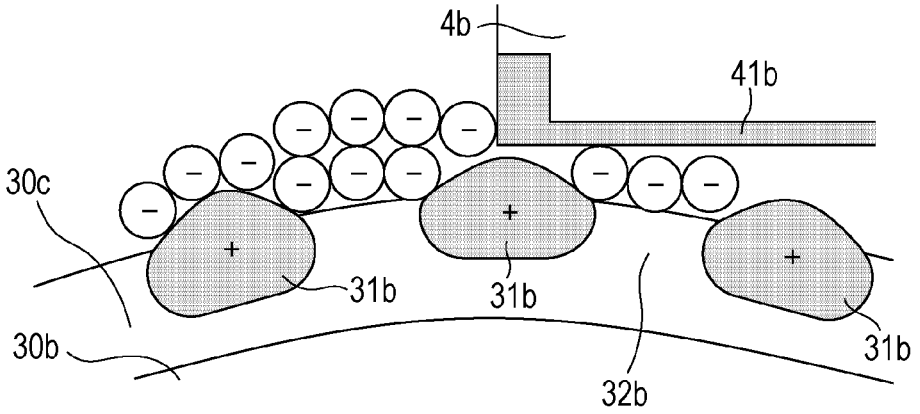

In this embodiment, as shown in FIG. 14A, the dielectric portions 31*b* are negatively charged by friction with the charging layer 41 when the toner particle diameter is smaller than the height of the protrusions of the dielectric portions 31*b*. As shown in FIG. 14B, the dielectric portions 31*b* are positively charged by friction with the toner when the toner particle diameter is greater than the height of the protrusions of the dielectric portions 31*b* since the friction between the dielectric portions 31*b* and the charging layer 41 does not occur.

The ghost image suppressing mechanism of this embodiment will now be described. This embodiment differs from the embodiment 1 in that the dielectric portions 31 are present in the protrusions and the polarity may be negative or positive depending on the relationship between the height of the protrusions and the toner particle diameter. However, as discussed in the embodiment 1, attraction of the toner to the surface of the development roller 3 according to the present invention occurs due to the gradient force of the microfields. Thus, the direction of the force the toner receives is the direction in which the magnitude of the electric field increases regardless of the direction of the electric field. The case in which the dielectric portions 31 are negatively charged is described in detail in the embodiment 3. Thus, the mechanism with which ghost images are suppressed is the same as in the embodiment 1 and detailed description therefore is omitted.

Figure 15A:
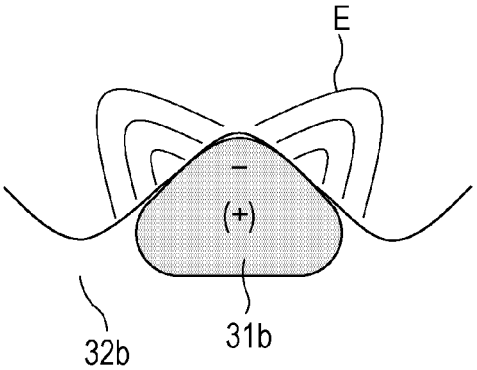
FIGS. 15A to 15F are diagrams illustrating a toner adhering mechanism according to the embodiment 1.
Figure 15D:
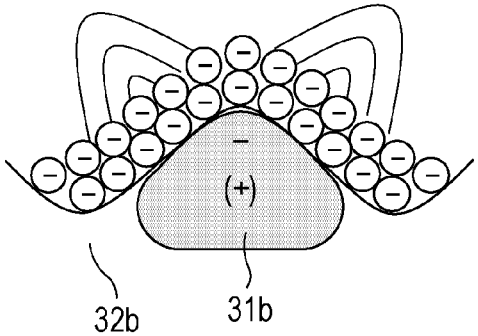
Figure 15B:
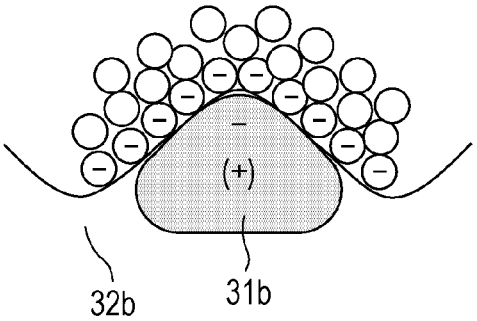
Figure 15E:
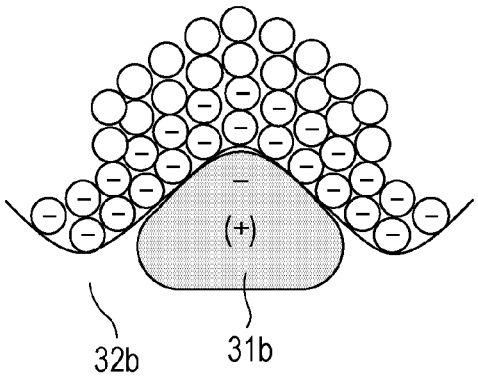
Figure 15C:
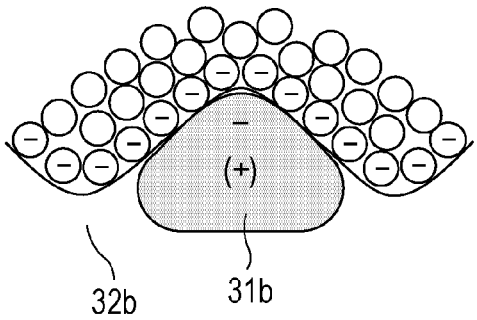
Figure 15F:
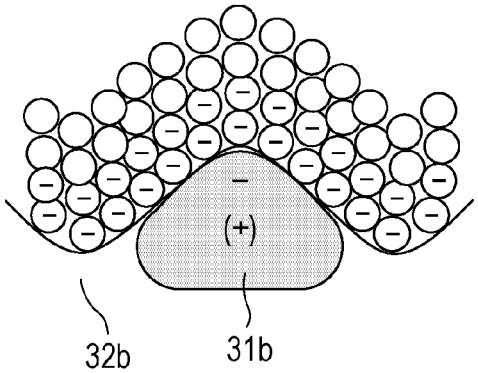
Figure 16A:
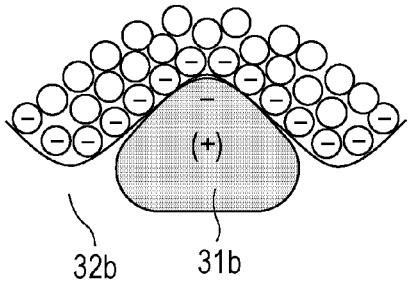
FIGS. 16A to 16F are diagrams illustrating a toner layer regulating mechanism according to the embodiment 2.
Figure 16D:
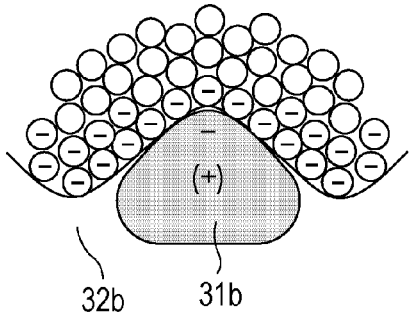
Figure 16B:
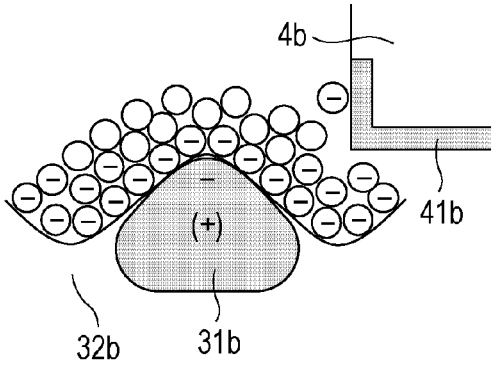
Figure 16E:
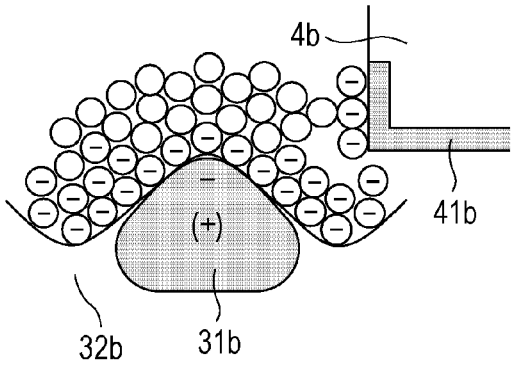
Figure 16C:
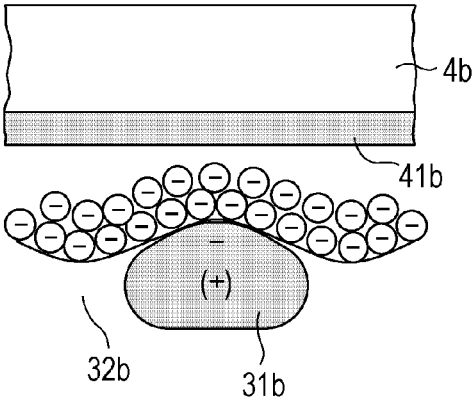
Figure 16F:
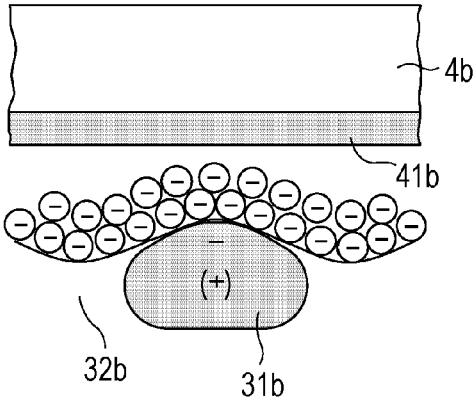

Diagrams showing the adhesion of the toner to the surface of the development roller 3 during formation of a solid image are shown in FIGS. 15A, 15B, and 15C, and diagrams showing adhesion of the toner during formation of a solid white image are shown in FIGS. 15D, 15E, and 15F. Diagrams showing regulation of the toner layer on the surface of the development roller 3 by using the regulating blade 4 during formation of a solid image are shown in FIGS. 16A, 16B, and 16C, and diagrams showing regulation of the toner layer during formation of a solid white image are shown in FIGS. 16D, 16E, and 16F.

The relationship among the toner average toner particle diameter r, the development roller 3 surface roughness Rzjis (ten-point average roughness), and ghosting and fogging when images are formed on 10000 A4 size sheets by using the development device of this embodiment is shown in Table 1.

TABLE 1

| Particle diameter r (μm) | Rzjis (μm) | Ghosting | Fogging |
|---|---|---|---|
| 6 | 3 | C | A |
| 6 | 5 | B | A |
| 6 | 6 | A | A |
| 6 | 17 | A | A |
| 6 | 18 | A | B |
| 6 | 19 | A | C |
| 8 | 4 | C | A |
| 8 | 7 | B | A |
| 8 | 8 | A | A |
| 8 | 23 | A | A |
| 8 | 24 | A | B |
| 8 | 25 | A | C |

Evaluation standard:
A: No occurrence,
B: Slight occurrence, acceptable level,
C: Unacceptable level Ghosting occurred when the development roller 3 surface Rzjis is small because the toner fused onto the dielectric portions 31 and microfields were not formed by friction between the dielectric portions 31*b* and the toner. In contrast, when the development roller 3 surface Rzjis is increased, the dielectric portions 31*b* are charged to have the same polarity as the toner due to friction with the charging layer 41 and thus occurrence of toner fusion can be suppressed. As Rzjis increases, the ratio of the dielectric portions 31*b* charged to the same polarity as the toner increases, and the toner fusion can be significantly suppressed at Rzjis≥r (toner average particle diameter). The ratio of the dielectric portions 31*b* charged to have the same polarity as the toner is determined by Rzjis and the particle size distribution of the toner. The reason why fogging occurs when Rzjis>3r is that three layers of the toner are readily formed on the irregularities on the surface of the development roller 3 and the layer sandwiched between the toner and the toner cannot be charged. Accordingly, in order to suppress fogging, Rzjis≤3r is preferably satisfied.

In sum, the image forming apparatus of this embodiment includes a development roller 3 having dielectric portions 31 scattered on the surface, and the components are configured such that the position of the dielectric portions 31 in the triboelectric series is on the same polarity side, relative to the regulating blade 4, as the normal charge polarity of the toner. In this manner, an image forming apparatus that uses a development device having no developer supply member, suppresses the decrease in density at the back end of the solid image and ghosting, and is capable of realizing long life can be provided.

In this embodiment, the above-described method is employed to form surface roughness on the development roller 3 but the effects of the present invention are not limited to this as long as a method with which a particular surface roughness is obtained is employed and the dielectric portions 31*b* are protruded. For example, a conductive substrate may be coated with a surface layer composed of a conductive resin in which insulating particles are dispersed and the surface may be polished to make the insulating particles protrude so as to achieve a particular surface roughness. In this manner the same effects as the present embodiment can be achieved.

Embodiment 3

Next, another embodiment of the image forming apparatus according to the present invention is described.

Figure 17:
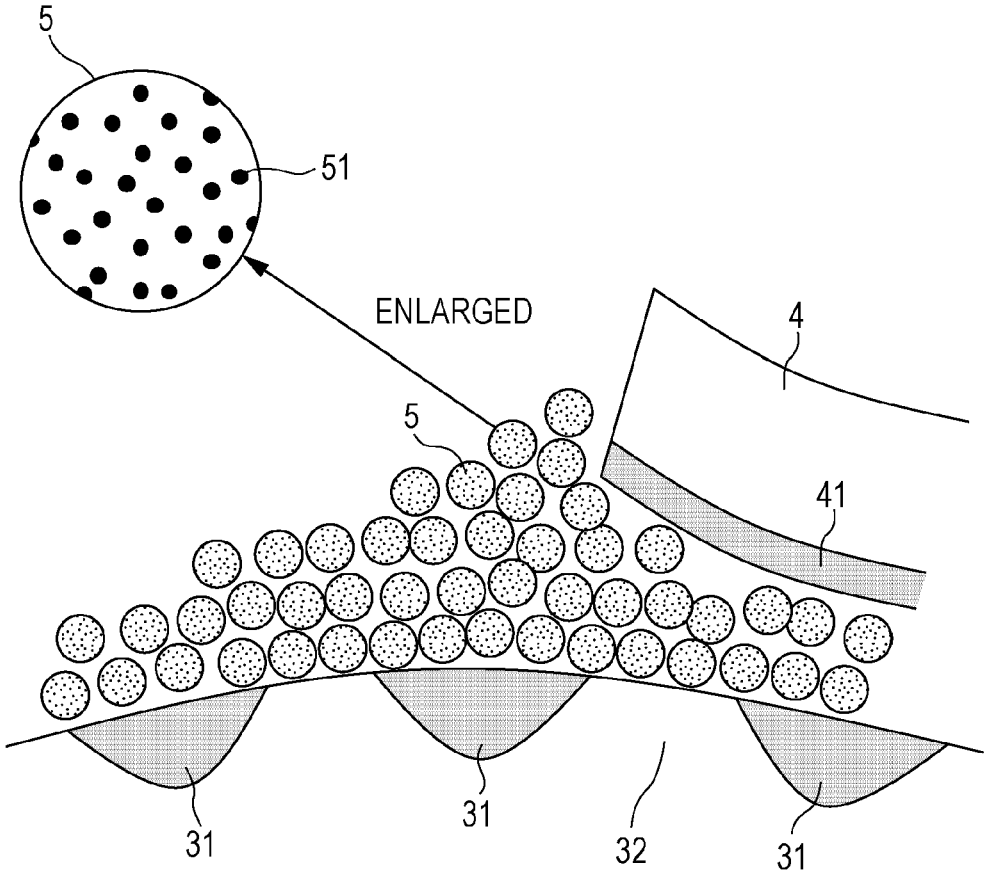
FIG. 17 is a diagram illustrating a development system according to embodiment 3.

In this embodiment, a developer in which an external additive 51 is scattered onto the surface of the toner 5 shown in FIG. 17 is employed in the image forming apparatus described in the embodiment 1. The feature of this embodiment is that the external additive 51 whose position in the triboelectric series is on the polarity side, relative to the dielectric portions 31, opposite to the normal charge polarity of the toner 5 is externally added to the surface of the toner 5 and the dielectric portions 31 are charged to the same polarity as the normal charge polarity of the toner due to the external additive 51. In other words, the feature is that the external additive 51, the order in the triboelectric series of which is (−) toner 5<dielectric portions 31<external additive 51 (+), is externally added to the surface of the toner so that the dielectric portions 31 are charged to the same polarity as the normal charge polarity of the toner. Other main structures are the same as in the embodiment 1.

In this embodiment, a developer was prepared by using titanium oxide as the external additive and treating the toner surface by rapidly stirring 0.5 parts by mass of the external additive relative to 100 parts by mass of the toner. Although the detailed description is provided below, the development system of this embodiment utilizes the relationship of the work functions of the dielectric portions 31 on the surface of the development roller 3, the toner 5, and the external additive 51. The work functions of the toner 5 and the external additive 51 were 6.01 eV and 5.41 eV when measured by the aforementioned method.

In this embodiment, the materials for the toner 5 and the external additive 51 are selected so that the above-described work functions are satisfied and the order of the triboelectric series is (−) toner 5<dielectric portions 31<charging layer 41<external additive 51 (+). Furthermore, the difference in work function between the toner 5 and the dielectric portions 31 is adjusted to be smaller than the difference between the dielectric portions 31 and the external additive 51, and the difference in work function between the toner 5 and the charging layer 41 is adjusted to be greater than the difference between the charging layer 41 and the external additive 51. According to this structure, the toner 5 is negatively charged and the external additive 51 is positively charged due to the friction between the toner 5 and the dielectric portions 31, and the dielectric portions 31 are negatively charged due to the friction with the external additive 51 having a greater work function difference. Moreover, due to the friction between the toner 5 and the charging layer 41 and due to the friction with the toner 5 having a greater difference in work function, the charging layer 41 is positively charged.

Figure 18A:
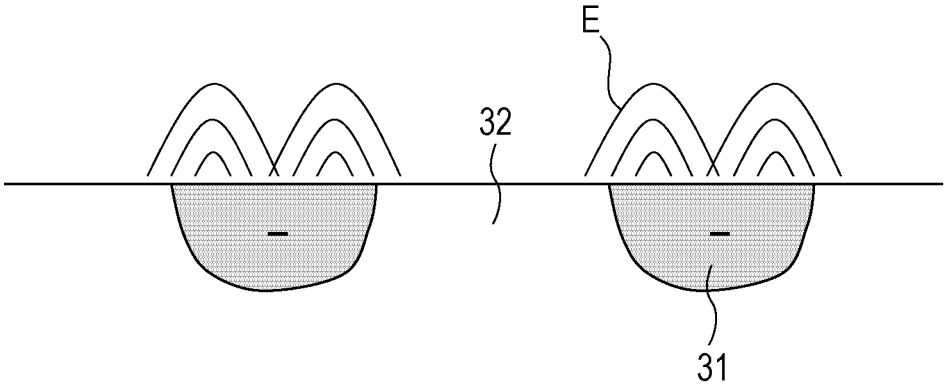
FIGS. 18A and 18B are diagrams illustrating a toner adhering mechanism according to the embodiment 3.
Figure 18B:
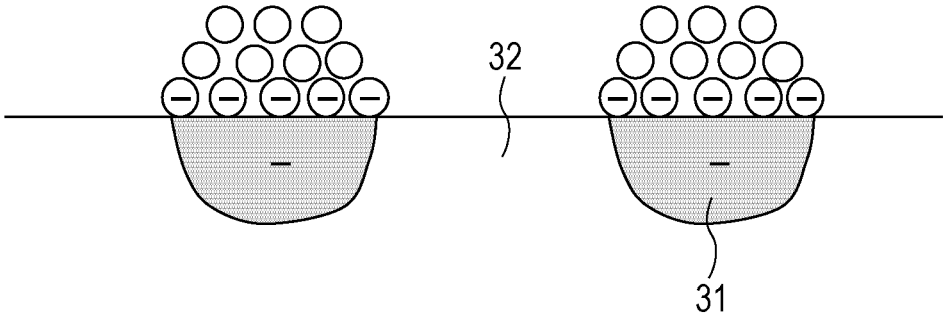
Figure 19A:
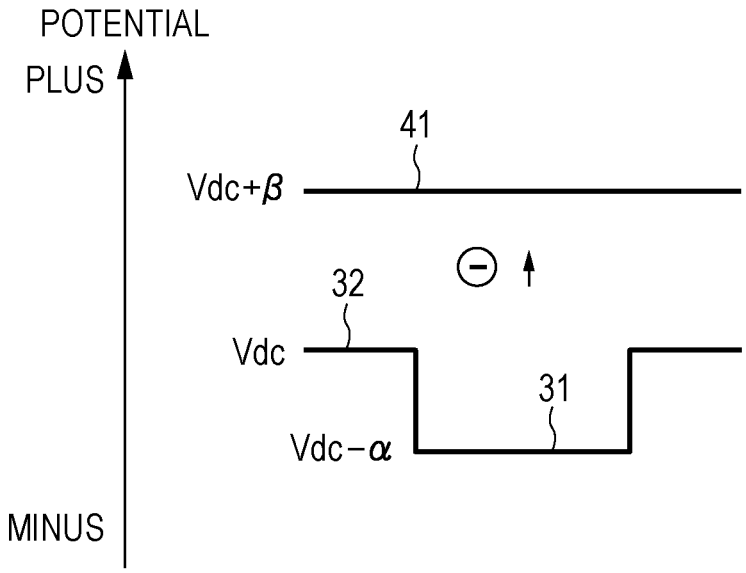
FIGS. 19A and 19B are potential graphs of conductive portions 32, dielectric portions 31, and a charging layer 41 according to the embodiment 3.

The ghost image suppressing mechanism of this embodiment is described. This embodiment differs from the embodiment 1 in that the dielectric portions 31 are negatively charged. Since attraction of the toner to the surface of the development roller 3 in this invention is due to gradient force of the microfields, the direction of the force the toner receives is the direction in which the magnitude of the electric field increases irrespective of the direction of the electric field. Accordingly, as shown in FIGS. 18A and 18B, even when the dielectric portions 31 have the same polarity as the toner, toner can be attracted by forming microfields. The mechanisms with which the toner adheres to the surface of the development roller 3 during formation of a solid image and during formation of a solid white image are the same as those in the embodiment 1. Next, the mechanism with which the toner layer is regulated with the regulating blade 4 is described. The potential relationship among the conductive portions 32, the dielectric portions 31, and the charging layer 41 is conductive portions 32=development bias (Vdc hereinafter), dielectric portions 31=Vdc−α, and charging layer 41=Vdc+β as shown in FIG. 19A. In this manner, as with the embodiment 1, the minus toner on the surface of the development roller 3 is made readily removable from the surface of the development roller 3 due to the electric field.

In other words, in this embodiment, because of the ghost image suppressing mechanism, occurrence of ghost images can be suppressed by making the toner coat amount after passage of the regulating position the same between during formation of the solid image and during formation of the solid white image. The results of forming images on 10000 A4 size sheets by using the development device of this embodiment and the development device of the embodiment 1 in the image forming apparatus shown in FIG. 1 are shown in Table 2.

TABLE 2

| Number of sheets on which images were formed | Ghosting | |
|---|---|---|
| | Embodiment 1 | Embodiment 2 |
| 0 | A | A |
| 1000 | A | A |
| 5000 | A | A |
| 10000 | B | A |

ABC evaluation standard:
A: no occurrence,
B: slight occurrence, acceptable level,
C: unacceptable level Ghosting occurred as the number of sheets on which images were formed increased in the embodiment 1 because the toner fused onto the dielectric portions 31 and microfields could not be formed by the friction between the dielectric portions 31 and the toner. In contrast, in the embodiment 3, since the dielectric portions 31 has the same polarity as the toner, occurrence of the toner fusion was reduced and a long life can be realized.

As described above, the image forming apparatus of this embodiment includes a development roller 3 having dielectric portions 31 scattered on the surface and other components are configured so that, in a triboelectric series, the position of the dielectric portions 31 is on the same polarity, relative to the regulating blade 4, side as the normal charge polarity of the toner. In this manner, an image forming apparatus that includes a development device having no developer supply member, suppresses the decrease in density at the back end of a solid image, and suppresses occurrence of ghosting can be provided.

Figure 19B:
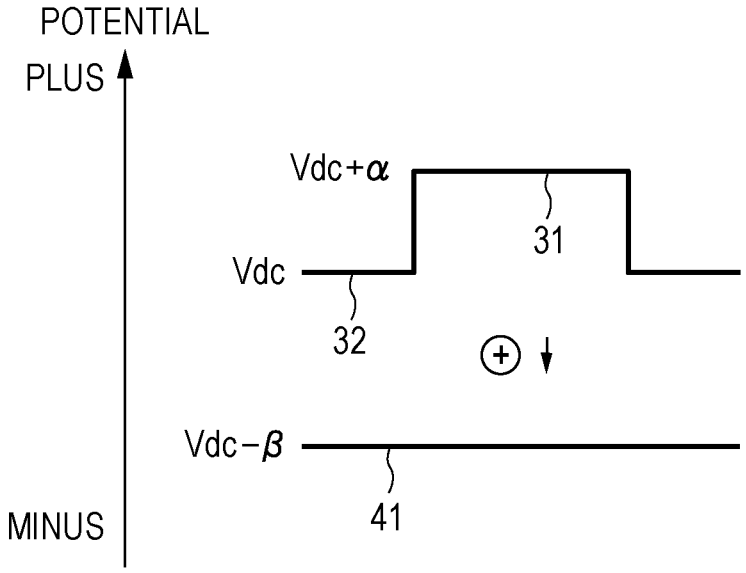

In this embodiment, the materials for the toner 5, the dielectric portions 31, and the charging layer 41 are as described above but are not limited to these. For example, when the toner is positively charged, the materials may be selected so that (−) external additive 51<charging layer 41<dielectric portions 31<toner 5 (+) so that the potential relationship among the conductive portions 32, the dielectric portions 31, and the charging layer 41 is as shown in FIG. 19B.

This embodiment is configured so that the triboelectric series is (−) toner 5<dielectric portions 31<charging layer 41<external additive 51 (+) but the triboelectric series may be (−) toner 5<dielectric portions 31<external additive 51<charging layer 41 (+) instead. In such a case, the difference in work function between the toner 5 and the dielectric portions 31 is adjusted to be smaller than the difference in work function between the dielectric portions 31 and the external additive 51 so that the dielectric portions 31 can be charged to the same polarity as the toner and the same effects as those of this embodiment can be achieved.

In this embodiment, titanium oxide is employed as the external additive 51. However, the external additive 51 may be any inorganic powder having the position in the triboelectric series described above among known inorganic powders described below. In particular, oxides of metals such as magnesium, zinc, and aluminum, complex metal oxide such as calcium titanate, and metal salts such as calcium carbonate that satisfy the position in the triboelectric series described above can be used.

Embodiment 4

Next, another embodiment of the image forming apparatus according to the present invention is described.

Figure 20:
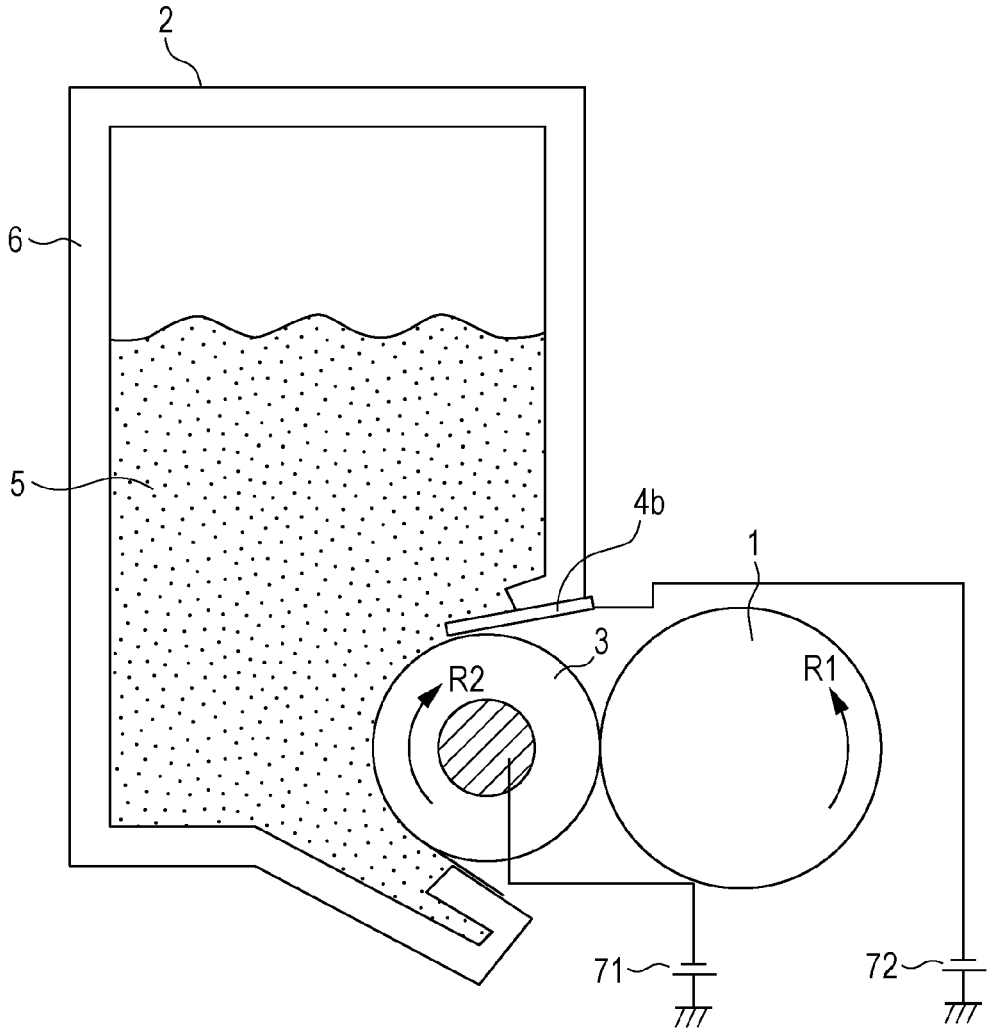
FIG. 20 is a schematic structural diagram of a development device etc., according to embodiment 4.

In this embodiment, the charging layer 41 of the regulating blade 4 is removed from the image forming apparatus described in the embodiment 1 and a blade bias Vbr is applied to a regulating blade 4*b* from a DC power source 72 (voltage applying apparatus) as shown in FIG. 20 so as to control the toner coat amount on the development roller 3 surface.

In this embodiment, an electric field that removes the toner from the dielectric portions 31 is formed by the blade bias. A DC power source 71 for applying the development bias Vdc is connected to the development roller 3. Other main structures are the same as the embodiment 1.

The potential difference (Vmf hereinafter) between the dielectric portions 31 and the conductive portions 32 during formation of images was measured according to the following procedure:

(1) After formation of a solid white image, the development roller 3 is removed and a measurement sample having a 1 cm×1 cm surface and a thickness of 3 mm is cut out therefrom.

(2) Thirty minutes after the completion of the formation of images, the difference in potential between the dielectric portions 31 and the conductive portions 32 is measured with a scanning probe microscope (SPA 300 produced by SII Nanotechnology Inc.) in a KFM mode.

(3) The potential attenuation in 30 minutes is calculated from the resistivity and dielectric constant of the dielectric portions 31 so as to determine Vmf.

In this embodiment, the value measured in (2) is 20 V. The acrylic resin particles of the dielectric portions 31 employed in this embodiment is dielectric constant=3.5 and resistivity=1E+15(Ω·m). Since the potential attenuation is 6%, Vmf=21.3 V during formation of images.

The results of forming images by applying a blade bias in this embodiment are shown in Table 3. Since a negatively charged toner is used in this embodiment, the potential difference (Vbr−Vdc) between the blade bias Vbr and the development bias Vdc is set to a positive value. In this manner, an electric field is generated in direction that causes the toner to move from the development roller 3 surface toward the regulating blade 4*b*.

TABLE 3

| Vbr-Vdc | Ghosting | Density |
|---|---|---|
| −100 V | C | A |
| 0 V | C | A |
| +20 V | B | A |
| +25 V | A | A |
| +50 V | A | A |
| +100 V | A | B |

ABC evaluation standard:
A: no occurrence,
B: slight occurrence, acceptable level,
C: unacceptable level Ghost images are suppressed by changing the potential difference (Vbr−Vdc) from minus to plus as shown in Table 3. The mechanism with which ghost images are suppressed is the same as the embodiment 1, i.e., the upper layer toner shown in FIGS. 7B and 7E is removed by the electric field generated by the potential difference (Vbr−Vdc). Since Vmf=21.3 V in this embodiment, ghost images can be significantly suppressed by controlling the potential difference (Vbr−Vdc) to be +25 V to +50 V, i.e., to be larger than Vmf. When the potential difference (Vbr−Vdc) is excessively increased toward plus (+100 V or more), the toner removing effect of the electric field on the development roller 3 is enhanced and the image density may decrease during regulation of the toner coat amount with the regulating blade 4. In such a case, an appropriate image density can be maintained by increasing the rotational speed of the development roller.

Figure 21A:
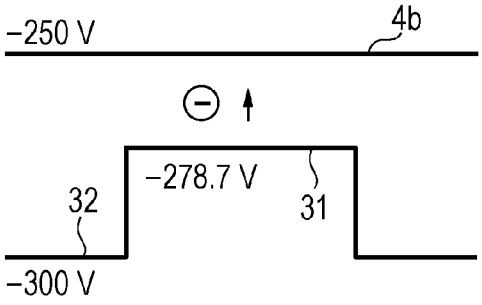
FIGS. 21A to 21D are potential graphs of conductive portions 32, dielectric portions 31, and a regulating blade 4*b* according to the embodiment 4.
Figure 21B:
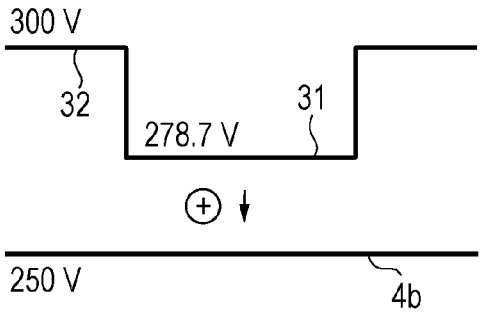
Figure 21C:
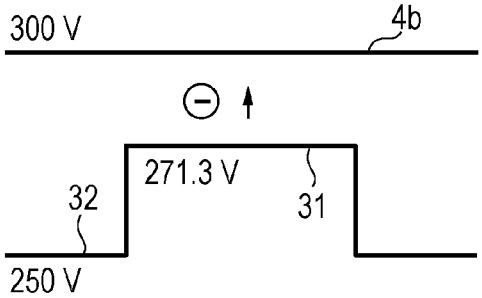
Figure 21D:
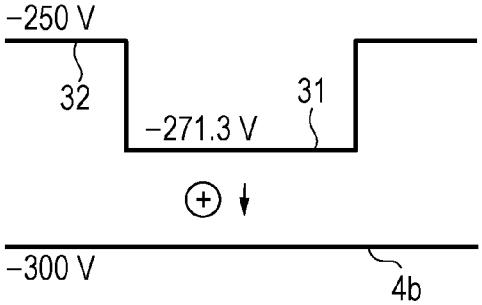

A potential graph of the conductive portions 32, the dielectric portions 31, and the regulating blade 4 of this embodiment is shown in FIG. 21A and those of modification examples of this embodiment are shown in FIGS. 21B, 21C, and 21D. FIG. 21A shows the case in which the toner is negatively charged and the developing bias is negative. FIG. 21B shows the case in which the toner is positively charged and the development bias is positive. FIG. 21C shows the case in which the toner is negatively charged and the development bias is positive. FIG. 21D shows the case in which the toner is positively charged and the development bias is negative. In any case, the potential relationship is set such that an electric field that removes the toner from the dielectric portions 31 is generated.

The potentials of the conductive portions 32, the dielectric portions 31, and the regulating blade 4 were set as shown in FIG. 21A and images were formed on 1000 A4 size sheets by using the development device of this embodiment shown in FIG. 20. An appropriate image density was maintained, image defects did not occur, and satisfactory images were obtained.

As described above, the image forming apparatus of this embodiment includes a development roller 3 having dielectric portions 31 scattered on the surface and a voltage is applied to the regulating blade 4*b* so that the difference in potential obtained by subtracting the potential of the dielectric portions 31 from the potential of the regulating blade 4*b* has a polarity opposite to the normal charge polarity of the toner. In this manner, an image forming apparatus that includes a development device having no developer supply member, suppresses the decrease in density at the back end of a solid image, and suppresses occurrence of ghosting can be provided.

Embodiment 5

Next, another embodiment of the image forming apparatus according to the present invention is described.

In this embodiment, the charging layer 41 of the regulating blade 4 is removed from the image forming apparatus described in the embodiment 2 and a blade bias Vbr is applied to the regulating blade 4*b* from the DC power source 72 as shown in FIG. 20 so as to control the toner coat amount on the development roller 3 surface. Other main structures are the same as those of the embodiment 2.

The results of forming images by applying a blade bias in the present embodiment are shown in Table 4. Since a negatively charged toner is used in this embodiment, the potential difference (Vbr−Vdc) between the blade bias Vbr and the development bias Vdc is set to a positive value. As a result, an electric field is generated in the direction that causes the toner to move from the development roller 3 surface to the regulating blade 4*b*. In this embodiment, the surface roughness of the development roller 3 is Rzjis=6 μm and the toner average particle diameter is 6 μm. In this embodiment, Vmf=21.3 V as in the embodiment 4.

TABLE 4

| Vbr-Vdc | Ghosting | Density |
|---|---|---|
| −100 V | C | A |
| 0 V | B | A |
| +20 V | B | A |
| +25 V | A | A |
| +50 V | A | A |
| +100 V | A | B |

ABC evaluation standard:
A: no occurrence,
B: slight occurrence, acceptable level,
C: unacceptable level Ghost images are suppressed by changing the potential difference (Vbr−Vdc) from minus to plus as shown in Table 4. The mechanism with which ghost images are suppressed is the same as in the embodiment 3, i.e., the upper layer toner shown in FIGS. 19B and 19E is removed by the electric field generated by the potential difference (Vbr−Vdc). As mentioned above, when the toner particle diameter is smaller than the height of the irregularities of the dielectric portions 31, the dielectric portions 31 become negatively charged by the friction with the charging layer 41 and, in other cases, positively charged by the friction with the toner. The ratio of the dielectric portions 31*b* negatively charged is large in this embodiment but there are dielectric portions 31 that are positively charged. Accordingly, ghost images can be significantly suppressed by increasing the potential difference (Vbr−Vdc) to be larger than Vmf=21.3 V so that electric fields for removal are generated in all of the dielectric portions 31*b*. If the potential difference (Vbr−Vdc) is excessively increased toward plus (+100 V or more), the toner removing effect of the electric field on the development roller 3 is enhanced and the image density may decrease during regulation of the toner coat amount with the regulating blade 4. In such a case, an appropriate image density can be maintained by increasing the rotational speed of the development roller.

In this embodiment, when the development roller 3 surface roughness Rzjis of 17 μm and a toner average particle diameter of 6 μm were employed, all of the dielectric portions 31 were negatively charged and thus ghost images did not occur at a potential difference (Vbr−Vdc)>0. In this embodiment, the selection of the blade bias may be appropriately determined on the basis of the Rzjis, the average toner particle diameter, the particle size distribution, etc. As for the potential graph of this embodiment, FIGS. 22A, 22B, 22C, and 22D is employed in the case where the dielectric portions 31*b* charged to the same polarity as the toner and those charge to the opposite polarity to the toner are mixed, and FIGS. 23A, 23B, 23C, and 23D is employed if all of the dielectric portions 31*b* are charged to the same polarity as the toner.

The mechanism with which the fusion of the toner onto the dielectric portions 31 is suppressed with the increase in number of sheets on which images are formed is the same as that of the embodiment 3.

Figure 22A:
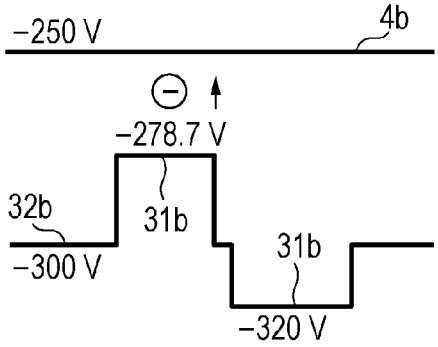
FIGS. 22A to 22D are potential graphs of conductive portions 32, dielectric portions 31, and a regulating blade 4*b* according to the embodiment 5.
Figure 22B:
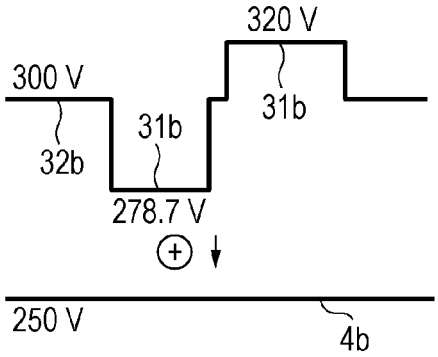
Figure 22C:
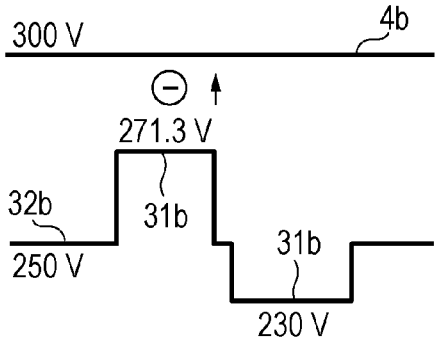
Figure 22D:
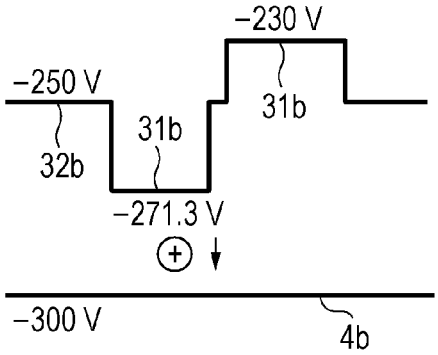
Figure 23A:
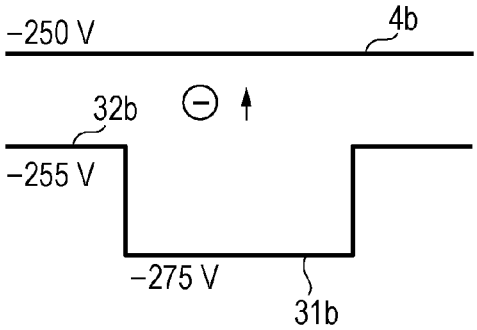
FIGS. 23A to 23D are potential graphs of conductive portions 32, dielectric portions 31, and a regulating blade 4*b* according to the embodiment 5.
Figure 23B:
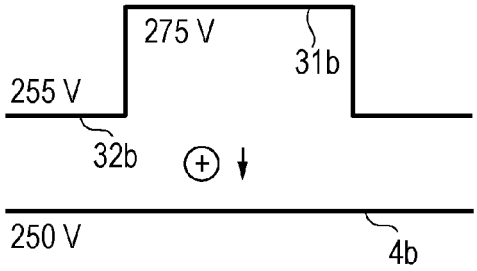
Figure 23C:
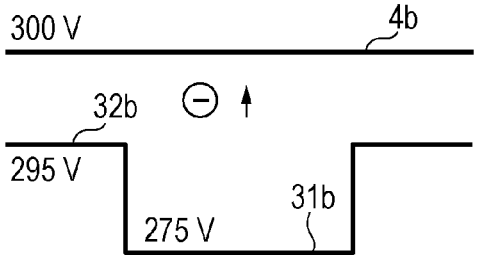
Figure 23D:
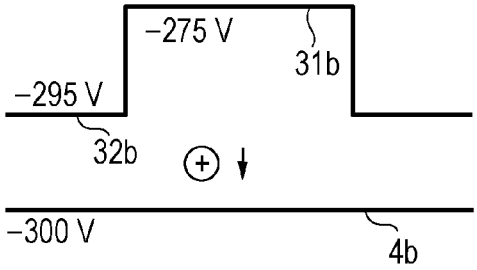

The development device shown in FIG. 20 according to this embodiment was used and the potentials of the conductive portions 32, the dielectric portions 31, and the regulating blade 4 were set as shown in FIG. 22A to form images on 10000 A4 size sheets. An appropriate image density was maintained, image defects did not occur, and satisfactory images were obtained.

As discussed above, the image forming apparatus of this embodiment includes a development roller 3 having dielectric portions 31 scattered on the surface and a voltage is applied to the regulating blade 4*b* so that the potential difference determined by subtracting the potential of the dielectric portions 31 from the potential of the regulating blade 4*b* is controlled to have a polarity opposite to the normal charge polarity of the toner. In this manner, an image forming apparatus that uses a development device having no developer supply member, suppresses the decrease in density at the back end of the solid image and ghosting, and is capable of realizing long life can be provided.

Embodiment 6

Next, another embodiment of the image forming apparatus according to the present invention is described.

In this embodiment, the charging layer 41 of the regulating blade 4 is removed from the image forming apparatus described in the embodiment 3 and a blade bias is applied to the regulating blade 4*b* as shown in FIG. 20 so as to control the toner coat amount on the surface of the development roller 3. Other main structures are the same as in the embodiment 3.

The results of forming images by applying the blade bias in this embodiment are shown in Table 5. Since a negatively charged toner is used in this embodiment, the potential difference (Vbr−Vdc) is set so that the (Vbr−Vdc) between the blade bias Vbr and the development bias Vdc is a positive value. In this manner, an electric field is generated in a direction that causes the toner to move from the development roller 3 surface to the regulating blade 4*b*.

TABLE 5

| Vbr-Vdc | Ghosting | Density |
|---|---|---|
| −100 V | C | A |
| 0 V | B | A |
| +5 V | A | A |
| +10 V | A | A |
| +50 V | A | A |
| +100 V | A | B |

ABC evaluation standard:
A: no occurrence,
B: slight occurrence, acceptable level,
C: unacceptable level As shown in Table 5, ghost images are suppressed by changing the potential difference (Vbr−Vdc) from minus to plus. The mechanism with which ghost images are suppressed is the same as in the embodiment 2, i.e., the upper layer toner shown in FIGS. 7B and 7E is removed by the electric field. Since the dielectric portions 31 are charged to the same polarity (−) as the toner in this embodiment, the conductive portions 32 have a potential that does not easily allow removal by the electric field. Accordingly, the potential difference (Vbr−Vdc) is adjusted to be larger than 0 so as to form an electric field that can remove the toner from both the dielectric portions 31 and the conductive portions 32 and ghost images can be significantly suppressed as a result. When the potential difference (Vbr−Vdc) is excessively increased (+100 V or more), the toner removing effect of the electric field on the development roller 3 is enhanced and the image density may decrease during regulation of the toner coat amount with the regulating blade 4. In such a case, an appropriate image density can be maintained by increasing the rotational speed of the development roller.

Figure 24A:
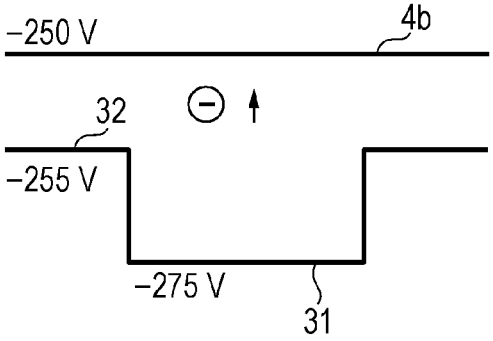
FIGS. 24A to 24D are potential graphs of conductive portions 32, dielectric portions 31, and a regulating blade 4*b* according to embodiment 6.
Figure 24B:
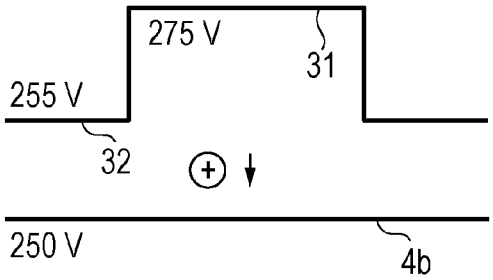
Figure 24C:
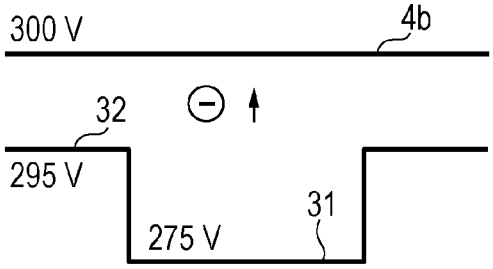
Figure 24D:
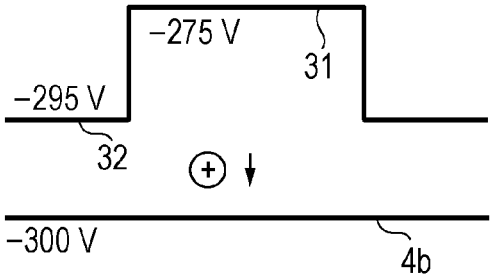

Here, the potential graph of the conductive portions 32, the dielectric portions 31, and the regulating blade 4*b* of this embodiment is shown in FIG. 24A, and the potential graphs of modification examples of this embodiment are shown in FIGS. 24B, 24C, and 24D. FIG. 24A shows the case in which the toner is negatively charged and the development bias is negative. FIG. 24B shows the case in which the toner is positively charged and the development bias is positive. FIG. 24C shows the case in which the toner is negatively charged and the development bias is positive. FIG. 24D shows the case in which the toner is positively negatively charged and the development bias is negative. In all cases, the potential relationship is set so that an electric field that removes the toner from the dielectric portions 31 is generated.

The mechanism with which the fusion of the toner onto the dielectric portions 31 caused by the increase in the number of sheets on which the images are formed is suppressed is the same as that of the embodiment 2.

The potentials of the conductive portions 32, the dielectric portions 31, and the regulating blade 4 were set as shown in FIG. 24A and images were formed on 10000 A4 size sheets by using the image forming apparatus of this embodiment shown in FIG. 20. An appropriate image density was maintained, image defects did not occur, and satisfactory images were obtained.

As described above, the image forming apparatus of this embodiment includes a development roller 3 having dielectric portions 31 scattered on the surface and a voltage is applied to the regulating blade 4*b* so that the difference in potential obtained by subtracting the potential of the dielectric portions 31 from the potential of the regulating blade 4*b* has a polarity opposite to the normal charge polarity of the toner. In this manner, an image forming apparatus that includes a development device having no developer supply member, suppresses the decrease in density at the back end of a solid image, and suppresses occurrence of ghosting can be provided.

As discussed above, according to the present invention, the decrease in density at the back end of a solid image and occurrence of ghosting can be suppressed with a development device that has no toner supply member that contacts the toner bearing member and supplies and removes the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2012/054799, filed Feb. 27, 2012, which is hereby incorporated by reference herein in its entirety.

The invention claimed is:

1. A development device comprising a container that contains a toner, a toner bearing member that has dielectric portions scattered on a surface thereof and bears the toner, and a regulating member that regulates a layer thickness of the toner on the toner bearing member, wherein, with respect to a triboelectric series, a position of the dielectric portions on the triboelectric series with respect to positions of the toner and regulating member, is such that the dielectric portions are more likely to be charged to have a same polarity as a normal charge polarity of the toner, than a polarity of the regulating member.

2. The development device according to claim 1, wherein the toner bearing member has protrusions on the surface and the dielectric portions are present in the protrusions.

3. The development device according to claim 2, wherein a ten point average roughness Rzjis of the surface of the toner bearing member and an average particle diameter r of the toner satisfy r≤Rzjis.

4. The development device according to claim 2, wherein a ten point average roughness Rzjis of the surface of the toner bearing member and an average particle diameter r of the toner satisfy Rzjis≤3r.

5. The development device according to claim 1, further comprising an external additive externally added to a surface of the toner, wherein, with respect to the triboelectric series, a position of the external additive on the triboelectric series with respect to positions of the toner and the dielectric portions, is such that the external additive is more likely to be charged to have an opposite polarity to the normal charge polarity of the toner, than the polarity of the dielectric portions, and wherein the dielectric portions are charged to the same polarity as the normal charge polarity of the toner due to the external additive.

6. The development device according to claim 1, further comprising an external additive externally added to a surface of the toner, wherein, with respect to the triboelectric series, a position of the external additive on the triboelectric series with respect to positions of the toner and the dielectric portions, is such that the external additive is more likely to be charged to have an opposite polarity to the normal charge polarity of the toner, than the polarity of the dielectric portions, and wherein a difference in work function between the toner and the dielectric portions is smaller than a difference in work function between the dielectric portions and the external additive.

7. The development device according to claim 6, wherein a difference in work function between the toner and the regulating member is larger than a difference in work function between the regulating member and the external additive.

8. The development device according to claim 1, wherein the regulating member has a guiding portion at an end thereof, the guiding portion being configured to guide the toner to outside a region where the regulating member opposes the toner bearing member, wherein, with respect to the triboelectric series, a position of the guiding portion on the triboelectric series with respect to positions of the toner and the dielectric portions, is such that the guiding portion is more likely to be charged to have an opposite polarity to the normal charge polarity of the toner, than a polarity of the dielectric portions.

9. The development device according to claim 1, wherein the toner bearing member has, on the surface thereof, conductive portions adjacent to the dielectric portions.

10. The development device according to claim 9, wherein the surface of the toner bearing member has a sea-island phase separation structure constituted by a domain phase that contains a polyester copolymer resin composed of formulae (A) and (B) below and a matrix phase of a polyester melamine resin containing formulae (A), (B), and (C) below, conductive fine particles are localized in the matrix phase, and the domain phase functions as the dielectric portions and the matrix phase functions as the conductive portions:

(A)

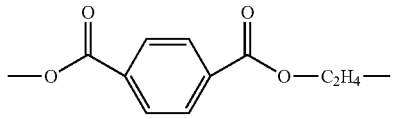

(B)

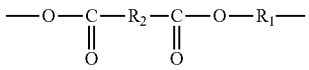

(C)

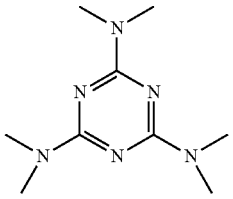

, wherein in formula (B), $R_1$ represents a linear alkylene group having 2 or more and 9 or less carbon atoms or a branched alkylene group having 6 or more and 9 or less carbon atoms and $R_2$ represents a linear alkylene group having 2 or more and 8 or less carbon atoms.

11. A process cartridge comprising the development device according to claim 1 and an image bearing member that bears an electrostatic latent image, wherein the process cartridge is configured to be removably loadable to an image forming apparatus main body.

12. An image forming apparatus comprising the development device according to claim 1 and an image bearing member that bears an electrostatic latent image, wherein an image is formed on a recording medium.

13. An image forming apparatus comprising the process cartridge according to claim 11, wherein an image is formed on a recording medium.

14. An image forming apparatus comprising a development device that includes a container that contains a toner, a toner bearing member that has dielectric portions scattered on a surface thereof and bears the toner, and a regulating member that regulates a layer thickness of the toner on the toner bearing member, and a voltage applying device that applies a voltage to the regulating member so that a potential difference obtained by subtracting a potential of the dielectric portions from a potential of the regulating member has a polarity opposite to a normal charge polarity of the toner.

15. The image forming apparatus according to claim 14, wherein, in the image forming apparatus according to claim 14, the toner bearing member has protrusions on the surface, and the dielectric portions are present in the protrusions.

16. The image forming apparatus according to claim 15, wherein a ten point average roughness Rzjis of the surface of the toner bearing member and an average particle diameter r of the toner satisfy r≤Rzjis.

17. The image forming apparatus according to claim 15, wherein a ten point average roughness Rzjis of the surface of the toner bearing member and an average particle diameter r of the toner satisfy Rzjis≤3r.

18. The image forming apparatus according to claim 14, further comprising an external additive externally added to a surface of the toner, a position of the external additive in the triboelectric series being on the polarity side, relative to the dielectric portions, opposite to the normal charge polarity of the toner, wherein the dielectric portions are charged to the same polarity as the normal charge polarity of the toner due to the external additive.

19. The image forming apparatus according to claim 14, further comprising an external additive externally added to a surface of the toner, a position of the external additive in the triboelectric series being on the polarity side, relative to the dielectric portions, opposite to the normal charge polarity of the toner, wherein a difference in work function between the toner and the dielectric portions is smaller than a difference in work function between the dielectric portions and the external additive.

20. The image forming apparatus according to claim 19, wherein a difference in work function between the toner and the regulating member is larger than a difference in work function between the regulating member and the external additive.

21. The image forming apparatus according to claim 14, wherein the regulating member has a guiding portion at an end thereof, the guiding portion being configured to guide the toner to outside a region where the regulating member opposes the toner bearing member, and a position of the guiding portion in the triboelectric series is on the polarity side, relative to the dielectric portions, opposite to the normal charge polarity of the toner.

22. The image forming apparatus according to claim 14, wherein the toner bearing member has, on the surface thereof, conductive portions adjacent to the dielectric portions.

23. The image forming apparatus according to claim 22, wherein the voltage applying device is configured to apply a voltage to the regulating member so that a potential difference obtained by subtracting the potential of the conductive portions from the potential of the regulating member has a polarity opposite to the normal charge polarity of the toner.

24. The image forming apparatus according to claim 22, wherein the surface of the toner bearing member has a sea-island phase separation structure constituted by a domain phase that contains a polyester copolymer resin composed of formulae (A) and (B) below and a matrix phase of a polyester melamine resin containing formulae (A), (B), and (C) below, conductive fine particles are localized in the matrix phase, and the domain phase functions as the dielectric portions and the matrix phase functions as the conductive portions:

(A)

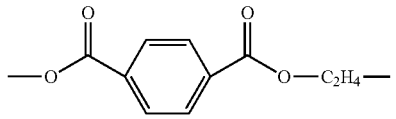

(B)

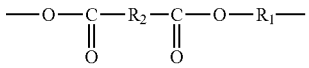

(C)

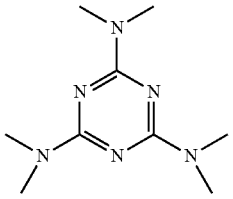

, wherein in formula (B), $R_1$ represents a linear alkylene group having 2 or more and 9 or less carbon atoms or a branched alkylene group having 6 or more and 9 or less carbon atoms and $R_2$ represents a linear alkylene group having 2 or more and 8 or less carbon atoms.

* * * * *